US011417312B2

(12) United States Patent
Tachibana

(10) Patent No.: US 11,417,312 B2
(45) Date of Patent: Aug. 16, 2022

(54) KEYBOARD INSTRUMENT AND METHOD PERFORMED BY COMPUTER OF KEYBOARD INSTRUMENT

(71) Applicant: CASIO COMPUTER CO., LTD., Tokyo (JP)

(72) Inventor: Toshiyuki Tachibana, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 195 days.

(21) Appl. No.: 16/814,374

(22) Filed: Mar. 10, 2020

(65) Prior Publication Data

US 2020/0294485 A1 Sep. 17, 2020

(30) Foreign Application Priority Data

Mar. 14, 2019 (JP) ..... JP2019-046605

(51) Int. Cl.
*G10L 13/033* (2013.01)
*G10H 1/00* (2006.01)
(Continued)

(52) U.S. Cl.
CPC ..... *G10L 13/0335* (2013.01); *G10H 1/0008* (2013.01); *G10H 1/344* (2013.01);
(Continued)

(58) Field of Classification Search
CPC ... G10L 13/0335; G10L 13/00; G10L 13/047; G10H 1/0008; G10H 1/344; G10H 2220/221
See application file for complete search history.

(56) References Cited

U.S. PATENT DOCUMENTS 5,621,182 A 4/1997 Matsumoto
5,703,311 A 12/1997 Ohta
(Continued)

FOREIGN PATENT DOCUMENTS

EP 2 270 773 A1 1/2011
EP 2930714 A1 10/2015
(Continued)

OTHER PUBLICATIONS

Tim Beamish et al (T. Beamish, K. MacLean and S. Fels, "Designing the haptic turntable for musical control," 11th Symposium on Haptic Interfaces for Virtual Environment and Teleoperator Systems, 2003. HAPTICS 2003. Proceedings., 2003, pp. 24-31, doi: 10.1109/HAPTIC.2003.1191221.) (Year: 2003).*
(Continued)

*Primary Examiner* — Pierre Louis Desir
*Assistant Examiner* — Keisha Y Castillo-Torres
(74) *Attorney, Agent, or Firm* — Chen Yoshimura LLP

(57) ABSTRACT

A keyboard instrument includes at least one processor that determines a first pattern of intonation to be applied to a first time segment of a voice data on the basis of a first user operation on a first operation element, causes a first singing voice for the first time segment to be digitally synthesized from the first segment data in accordance with the determined first pattern of intonation, determines a second pattern of intonation to be applied to the second time segment of the voice data on the basis of a second user operation on a second operation element, and causes a second singing voice for the second time segment to be digitally synthesized from the second segment data in accordance with the determined second pattern of intonation.

12 Claims, 14 Drawing Sheets

(51) Int. Cl.
*G10L 13/00* (2006.01)
*G10H 1/34* (2006.01)
*G10L 13/047* (2013.01)

(52) U.S. Cl.
CPC ..... *G10L 13/00* (2013.01); *G10L 13/047* (2013.01); *G10H 2220/221* (2013.01)

(56) References Cited

U.S. PATENT DOCUMENTS

| | | | | |
|---|---|---|---|---|
| 5,747,715 | A | 5/1998 | Ohta et al. | |
| 5,750,912 | A | 5/1998 | Matsumoto | |
| 5,889,223 | A | 3/1999 | Matsumoto | |
| 6,337,433 | B1 | 1/2002 | Nishimoto | |
| 6,369,311 | B1 | 4/2002 | Iwamoto | |
| 8,008,563 | B1 | 8/2011 | Hastings | |
| 10,325,581 | B2 | 6/2019 | Ogasawara | |
| 2002/0005111 | A1* | 1/2002 | Ludwig | G10H 3/26 84/645 |
| 2002/0017187 | A1 | 2/2002 | Takahashi | |
| 2003/0009344 | A1 | 1/2003 | Kayama et al. | |
| 2004/0040434 | A1 | 3/2004 | Kondo et al. | |
| 2005/0137862 | A1 | 6/2005 | Monkowski | |
| 2005/0257667 | A1 | 11/2005 | Nakamura | |
| 2006/0015344 | A1 | 1/2006 | Kemmochi | |
| 2006/0111908 | A1 | 5/2006 | Sakata | |
| 2006/0173676 | A1* | 8/2006 | Kemmochi | G10L 13/06 704/207 |
| 2009/0306987 | A1 | 12/2009 | Nakano et al. | |
| 2009/0307207 | A1 | 12/2009 | Murray | |
| 2011/0000360 | A1* | 1/2011 | Saino | G10H 1/361 84/622 |
| 2014/0006031 | A1 | 1/2014 | Mizuguchi et al. | |
| 2016/0111083 | A1 | 4/2016 | Iriyama | |
| 2017/0025115 | A1 | 1/2017 | Tachibana et al. | |
| 2017/0140745 | A1 | 5/2017 | Nayak et al. | |
| 2018/0018949 | A1 | 1/2018 | Sullivan et al. | |
| 2018/0277075 | A1 | 9/2018 | Nakamura | |
| 2018/0277077 | A1 | 9/2018 | Nakamura | |
| 2018/0277080 | A1 | 9/2018 | Nakamura | |
| 2019/0096372 | A1 | 3/2019 | Setoguchi | |
| 2019/0096373 | A1 | 3/2019 | Setoguchi | |
| 2019/0096379 | A1 | 3/2019 | Iwase | |
| 2019/0198001 | A1 | 6/2019 | Danjo | |
| 2019/0304327 | A1 | 10/2019 | Setoguchi | |
| 2019/0318712 | A1 | 10/2019 | Nakamura et al. | |
| 2019/0318715 | A1 | 10/2019 | Danjyo et al. | |
| 2019/0392798 | A1 | 12/2019 | Danjyo et al. | |
| 2019/0392799 | A1 | 12/2019 | Danjo et al. | |
| 2019/0392807 | A1 | 12/2019 | Danjo et al. | |
| 2021/0012758 | A1 | 1/2021 | Danjo et al. | |
| 2021/0027753 | A1 | 1/2021 | Danjo et al. | |
| 2021/0193114 | A1 | 6/2021 | Danjo et al. | |
| 2021/0295819 | A1 | 9/2021 | Danjo et al. | |
| 2022/0076651 | A1 | 3/2022 | Danjo et al. | |
| 2022/0076658 | A1 | 3/2022 | Danjo et al. | |

FOREIGN PATENT DOCUMENTS

| | | | |
|---|---|---|---|
| EP | 3159892 | A1 | 4/2017 |
| JP | H04-238384 | A | 8/1992 |
| JP | H06-332449 | A | 12/1994 |
| JP | H09-050287 | A | 2/1997 |
| JP | 2001-67078 | A | 3/2001 |
| JP | 2004-86067 | A | 3/2004 |
| JP | 2005-331806 | A | 12/2005 |
| JP | 2006-146095 | A | 6/2006 |
| JP | 2011-013454 | A | 1/2011 |
| JP | 2013-231872 | A | 11/2013 |
| JP | 2013231872 | A * | 11/2013 |
| JP | 2014-10190 | A | 1/2014 |
| JP | 2014-62969 | A | 4/2014 |
| JP | 2016-206323 | A | 12/2016 |
| JP | 2017-27021 | A | 2/2017 |
| JP | 2017-97176 | A | 6/2017 |
| JP | 2017-107228 | A | 6/2017 |
| JP | 2017-194594 | A | 10/2017 |
| JP | 2017194594 | A * | 10/2017 |

OTHER PUBLICATIONS

Japanese Office Action dated May 28, 2019, in a counterpart Japanese patent application No. 2018-078110. (Cited in the related U.S. Appl. No. 16/384,861 and a machine translation (not reviewed for accuracy) attached.).

Japanese Office Action dated May 28, 2019, in a counterpart Japanese patent application No. 2018-078113. (Cited in the related U.S. Appl. No. 16/384,883 and a machine translation (not reviewed for accuracy) attached.).

U.S. Appl. No. 16/447,586, filed Jun. 20, 2019.

U.S. Appl. No. 16/447,630, filed Jun. 20, 2019.

U.S. Appl. No. 16/447,572, filed Jun. 20, 2019.

U.S. Appl. No. 16/384,861, filed Apr. 15, 2019.

U.S. Appl. No. 16/384,883, filed Apr. 15, 2019.

Japanese Office Action dated May 28, 2019, in a counterpart Japanese patent application No. 2018-118055. (Cited in the related U.S. Appl. No. 16/447,572 and a machine translation (not reviewed for accuracy) attached.).

Japanese Office Action dated May 28, 2019, in a counterpart Japanese patent application No. 2018-118056. (Cited in the related U.S. Appl. No. 16/447,586 and a machine translation (not reviewed for accuracy) attached.).

European Search Report dated Oct. 29, 2019, in a counterpart European patent application No. 19181426.8. (Cited in the related U.S. Appl. No. 16/447,572.).

European Search Report dated Oct. 29, 2019, in a counterpart European patent application No. 19181429.2. (Cited in the related U.S. Appl. No. 16/447,586.).

Merlijn Blaauw et al., "A Neural Parametric Singing Synthesizer Modeling Timbre and Expression from Natural Songs", Applied Sciences, vol. 7, No. 12, Dec. 18, 2017 (Dec. 18, 2017), p. 1313, XP055627719 (Cited in the related U.S. Appl. No. 16/447,586.).

Masanari Nishimura et al., "Singing Voice Synthesis Based on Deep Neural Networks", Interspeech 2016, Jan. 2016, Sep. 8, 2016 (Sep. 8, 2016), pp. 2478-2482, XP055627666 (Cited in the related U.S. Appl. No. 16/447,586.).

U.S. Appl. No. 17/036,500, filed Sep. 29, 2020.

U.S. Appl. No. 17/036,582, filed Sep. 29, 2020.

Kei Hashimoto and Shinji Takaki, "Statistical parametric speech synthesis based on deep learning", Journal of the Acoustical Society of Japan, vol. 73, No. 1 (2017), pp. 55-62 (Mentioned in paragraph Nos. 22-23 and 37 of the specification as a concise explanation of relevance.).

Shinji Sako, Keijiro Saino, Yoshihiko Nankaku, Keiichi Tokuda, and Tadashi Kitamura, "A trainable singing voice synthesis system capable of representing personal characteristics and singing styles", Information Processing Society of Japan (IPSJ) Technical Report, Music and Computer (MUS) 2008 (12 (2008-MUS-074)), pp. 39-44, Feb. 8, 2008 (Mentioned in paragraph Nos. 37-38 of the specification; English abstract included as a concise explanation of relevance.).

* cited by examiner

| | | | |
|---|---|---|---|
| Header chunk | | ChunkID | Fixed string "MThd"=0x4d546864 |
| | | ChunkSize | Length of header chunk =0x00000006 |
| | | FormatType | Format: e.g., 0x0001 |
| | | NumberOfTrack | Number of tracks: e.g., 0x0002 |
| | | TimeDivision | Timebase: e.g., 0x1e0 |
| First track chunk (lyric part) | | ChunkID | Fixed string "MTrk"=0x4d54726b |
| | | ChunkSize_1 | Length of first track chunk |
| | DeltaTime_1[0] | DeltaTime | Wait time since last event |
| | Event_1[0] | Event | Event |
| | DeltaTime_1[1] | DeltaTime | Wait time since last event |
| | Event_1[1] | Event | Event |
| | ... | ... | |
| | DeltaTime_1[L-1] | DeltaTime | Wait time since last event |
| | Event_1[L-1] | Event | Must have "End of Track" at end of track |
| Second track chunk (accompaniment part) | | ChunkID | Fixed string "MTrk"=0x4d54726b |
| | | ChunkSize_2 | Length of second track chunk |
| | DeltaTime_2[0] | DeltaTime | Wait time since last event |
| | Event_2[0] | Event | Event |
| | DeltaTime_2[1] | DeltaTime | Wait time since last event |
| | Event_2[1] | Event | Event |
| | ... | ... | |
| | DeltaTime_2[M-1] | DeltaTime | Wait time since last event |
| | Event_2[M-1] | Event | Must have "End of Track" at end of track |

FIG. 5

600

| Measure number | Beat number | Bend curve number |
|---|---|---|
| 0 | 0 | – |
| 0 | 1 | – |
| 0 | 2 | – |
| 0 | 3 | – |
| 1 | 0 | 0 |
| 1 | 1 | 0 |
| 1 | 2 | 0 |
| 1 | 3 | 0 |
| ... | ... | ... |
| 3 | 0 | 4 |
| 3 | 1 | 4 |
| 3 | 2 | 4 |
| 3 | 3 | 4 |
| 4 | 0 | 2 |
| 4 | 1 | 2 |
| 4 | 2 | 3 |
| 4 | 3 | 3 |
| 5 | 0 | 1 |
| 5 | 1 | 1 |
| 5 | 2 | 1 |
| 5 | 3 | 1 |
| ... | ... | ... |
| 7 | 0 | 4 |
| 7 | 1 | 0 |
| 7 | 2 | 1 |
| 7 | 3 | 1 |
| ... | ... | ... |

601 (#0)

601 (#1)

FIG. 6

700

| | Address offset | Bend value | |
|---|---|---|---|
| BendCurve[0] | 0 | 1.00 | 401 (#0) |
| | 1 | 1.00 | |
| | 2 | 1.00 | |
| | ... | ... | |
| | R−2 | 2.50 | |
| | R−1 | 3.00 | |
| BendCurve[1] | 0 | 1.00 | 401 (#1) |
| | 1 | 1.00 | |
| | 2 | 1.00 | |
| | ... | ... | |
| | R−2 | 2.50 | |
| | R−1 | 3.00 | |
| BendCurve[2] | 0 | 1.00 | 401 (#2) |
| | 1 | 1.00 | |
| | 2 | 1.00 | |
| | ... | ... | |
| | R−2 | 2.50 | |
| | R−1 | 3.00 | |
| BendCurve[3] | 0 | 1.00 | 401 (#3) |
| | 1 | 1.00 | |
| | 2 | 1.00 | |
| | ... | ... | |
| | R−2 | 2.50 | |
| | R−1 | 3.00 | |

FIG. 7

KEYBOARD INSTRUMENT AND METHOD PERFORMED BY COMPUTER OF KEYBOARD INSTRUMENT

BACKGROUND OF THE INVENTION

Technical Field

The present invention relates to a keyboard instrument, and a method performed by a computer in the keyboard instrument, with which the performance of rap or the like is possible.

Background Art

There is a singing style known as "rap". Rap is a musical technique in which spoken word or other such content is sung in time with the temporal progression of a musical rhythm, meter, or melody line. In rap, colorful musical expression is made possible by, among other things, the extemporaneous change of intonation.

Thus, as rap has both lyrics and flow (rhythm, meter, melody line), rap is extremely challenging to sing. If at least some of the musical elements in the aforementioned flow in rap were to be automated and the remaining musical elements able to be performed in time therewith using an electronic musical instrument or the like, rap would become accessible to even beginning rappers.

One known piece of conventional technology for automating singing is an electronic musical instrument that outputs a singing voice synthesized using concatenative synthesis, in which fragments of recorded speech are connected together and processed (for example, see Japanese Patent Application Laid-Open Publication No. H09-050287).

However, although with this conventional technology it is possible to specify pitch on the electronic musical instrument in time with the automatic progression of synthesized-voice-based singing, the intonation that is characteristic to rap cannot be controlled in real time.

Additionally, it has hitherto been difficult to apply sophisticated intonations in not only rap, but in other musical instrument performances as well.

An advantage of the present invention is that desired intonations are able to be applied in instrumental or vocal performances through a simple operation.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a keyboard instrument comprising: a keyboard that includes a row of a plurality of keys; a plurality of operation elements provided behind the row of the plurality of keys on an instrument casing, the plurality of operation elements including a first operation element associated with a first segment data for a first time segment of a voice data that is to be output, and a second operation element associated with a second segment data for a second time segment that immediately follows the first time segment of the voice data; and at least one processor, wherein the at least one processor: determines a first pattern of intonation to be applied to the first time segment of the voice data on the basis of a first user operation on the first operation element, causes a first voice for the first time segment to be digitally synthesized from the first segment data in accordance with the determined first pattern of intonation and causes the digitally synthesized first voice to output, determines a second pattern of intonation to be applied to the second time segment of the voice data on the basis of a second user operation on the second operation element, and causes a second voice for the second time segment to be digitally synthesized from the second segment data in accordance with the determined second pattern of intonation and causes the digitally synthesized second voice to output.

In another aspect, the present disclosure provides a method executed by the above-described at least one processor, including the above-enumerated processes performed by the at least one processor.

It is to be understood that both the foregoing general description and the following detailed description are exemplary and explanatory, and are intended to provide further explanation of the invention as claimed.

BRIEF DESCRIPTION OF THE DRAWINGS

FIG. 5 is a diagram illustrating an example data configuration in the embodiments.

FIG. 6 is a diagram illustrating an example data configuration in a bend curve settings table of the embodiments.

FIG. 7 is a diagram illustrating an example data configuration in a bend curve table of the embodiments.

DETAILED DESCRIPTION OF EMBODIMENTS

Figure 1:
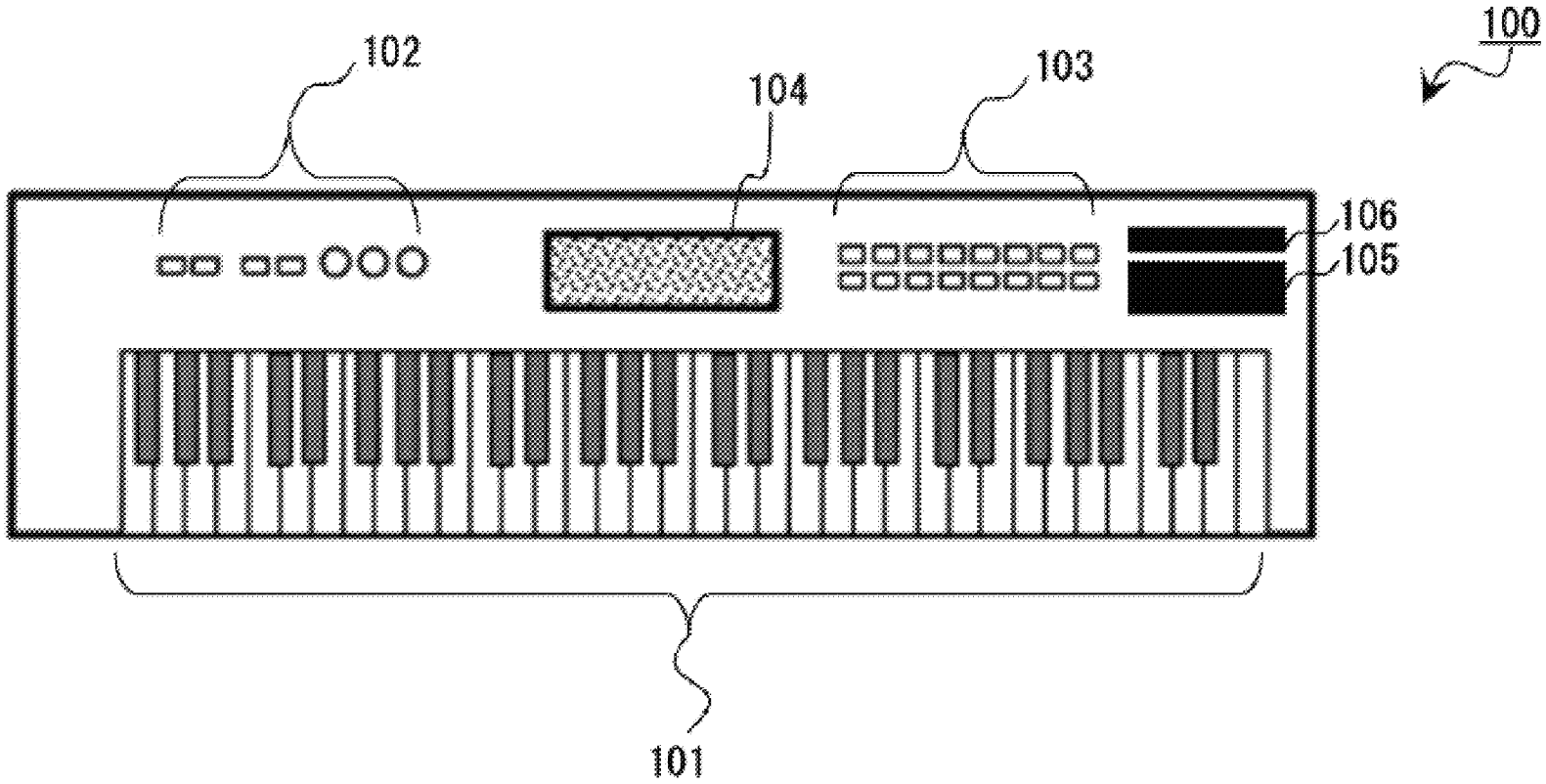
FIG. 1 is a diagram illustrating an example external view of an embodiment of an electronic keyboard instrument of the present invention.

Embodiments of the present invention will be described in detail below with reference to the drawings. FIG. 1 is a diagram illustrating an example external view of an embodiment of an electronic keyboard instrument 100 that is equipped with an automatic performance unit, which serves as an information processing unit. The electronic keyboard instrument 100 is provided with, inter alia, a keyboard 101, a first switch panel 102, a second switch panel 103, a liquid crystal display (LCD) 104, bend sliders 105, and bend switches 106. The keyboard 101 is made up of a plurality of keys serving as performance operation elements. The first switch panel 102 is used to specify various settings, such as specifying volume, setting a tempo for rap playback, initiating rap playback, and playing back an accompaniment. The second switch panel 103 is used to make rap and accompaniment selections, select tone color, and so on. The LCD 104 displays a musical score and lyrics during the playback of a rap, and information relating to various settings. The bend sliders 105 (also called sliding operation elements 105) are used to specify a bend curve (intonation pattern) for, e.g., the pitch of a rap voice that is vocalized. The bend switches 106 are used to enable/disable specifications made with the bend sliders 105. Although not illustrated in the drawings, the electronic keyboard instrument 100 is also provided with a speaker that emits musical sounds generated by playing of the electronic keyboard instrument 100. The speaker is provided at the underside, a side, the rear side, or other such location on the electronic keyboard instrument 100.

As illustrated in FIG. 1, the plurality of operation elements (sliding operation elements 105) are provided behind the keys in the lengthwise direction thereof (a user playing the keyboard instrument being in front of the keys in the lengthwise direction thereof), and on a top side (upper side) of an instrument casing. Similarly to the plurality of operation elements, the first switch panel 102, the second switch panel 103, the LCD 104, and the bend switches 106 are also provided behind the keys in the lengthwise direction thereof and on the top side of the instrument casing.

The plurality of operation elements do not have to be sliding operation elements 105, and may be rotating operation elements (knob operation elements) 105 or button operation elements 105.

Figure 2:
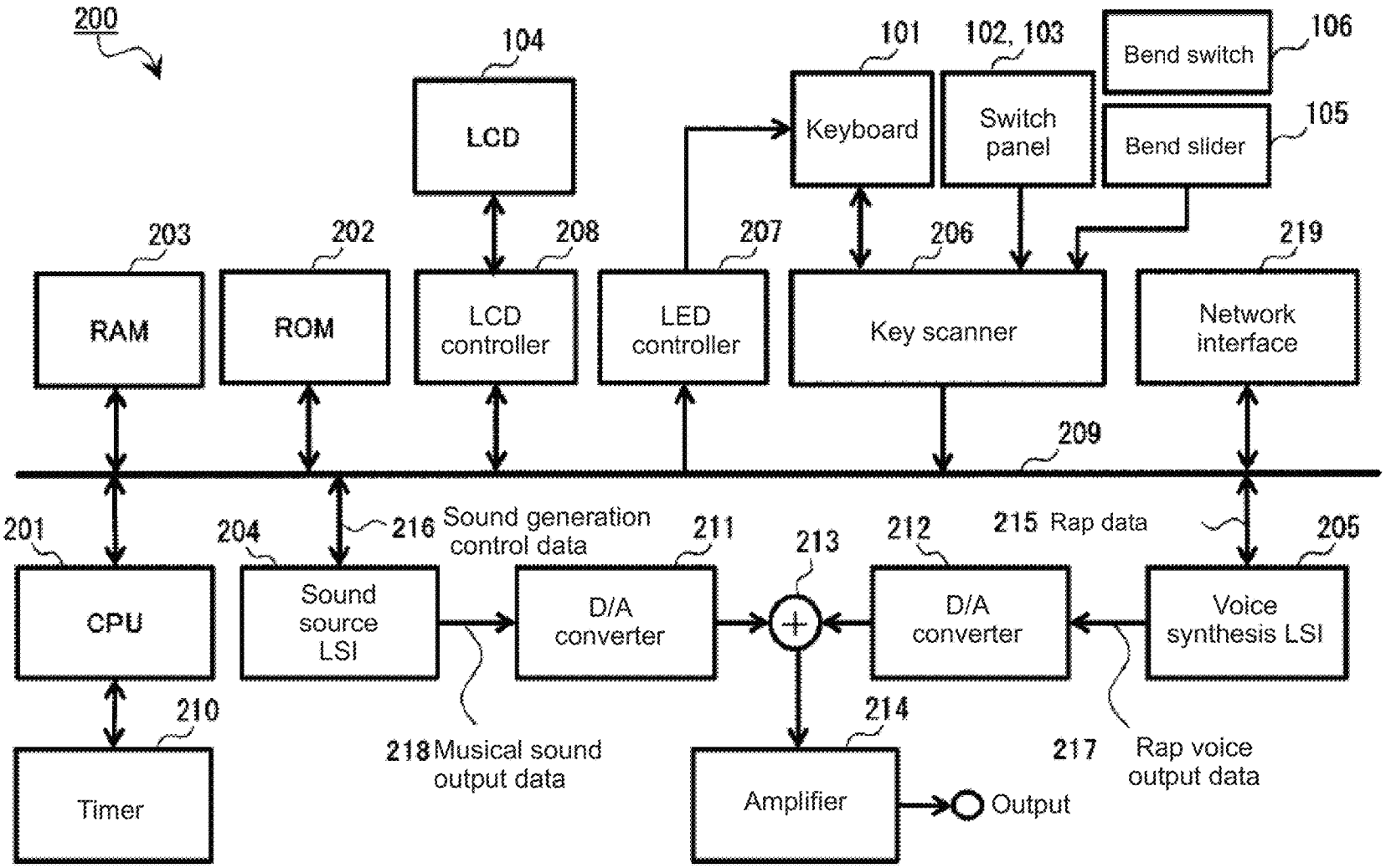
FIG. 2 is a block diagram illustrating an example hardware configuration for an embodiment of a control system of the electronic keyboard instrument.

FIG. 2 is a diagram illustrating an example hardware configuration for an embodiment of a control system 200 in the electronic keyboard instrument 100 of FIG. 1 that is equipped with an automatic performance unit. In the control system 200 in FIG. 2, a central processing unit (CPU) 201, a read-only memory (ROM) 202, a random-access memory (RAM) 203, a sound source large-scale integrated circuit (LSI) 204, a voice synthesis LSI 205, a key scanner 206, an LED controller 207, and an LCD controller 208 are each connected to a system bus 209. The key scanner 206 is connected to the keyboard 101, to the first switch panel 102, to the second switch panel 103, to the bend sliders 105, and to the bend switches 106 in FIG. 1. The LED controller 207 is connected to the keyboard 101 in FIG. 1. The LCD controller 208 is connected to the LCD 104 in FIG. 1. The CPU 201 is also connected to a timer 210 for controlling an automatic performance sequence. Musical sound output data 218 output from the sound source LSI 204 is converted into an analog musical sound output signal by a D/A converter 211, and rap voice output data 217 output from the voice synthesis LSI 205 is converted into an analog rap voice output signal by a D/A converter 212. The analog musical sound output signal and the analog rap sound output signal are mixed by a mixer 213, and after being amplified by an amplifier 214, this mixed signal is output from an output terminal or the non-illustrated speaker.

Using the RAM 203 as working memory, the CPU 201 executes an automatic performance control program stored in the ROM 202 and thereby controls the operation of the electronic keyboard instrument 100 in FIG. 1. The ROM 202 also stores musical piece data, which includes lyric data and accompaniment data, in addition to the aforementioned control program and various kinds of permanent data.

The CPU 201 is provided with the timer 210 used in the present embodiment. The timer 210, for example, counts the progression of automatic performance in the electronic keyboard instrument 100.

Following a sound generation control instruction from the CPU 201, the sound source LSI 204 reads musical sound waveform data from a non-illustrated waveform ROM, for example, and outputs the musical sound waveform data to the D/A converter 211. The sound source LSI 204 is capable of 256-voice polyphony.

When the voice synthesis LSI 205 is given, as rap data 215, text data for lyrics and information relating to pitch by the CPU 201, the voice synthesis LSI 205 synthesizes voice data for a corresponding rap voice and outputs this voice data to the D/A converter 212.

The key scanner 206 regularly scans the pressed/released states of the keys on the keyboard 101 and the operation states of the switches on the first switch panel 102, the second switch panel 103, the bend sliders 105, and the bend switches 106 in FIG. 1, and sends interrupts to the CPU 201 to communicate any state changes.

The LCD controller 208 is an integrated circuit (IC) that controls the display state of the LCD 104.

Figure 3:
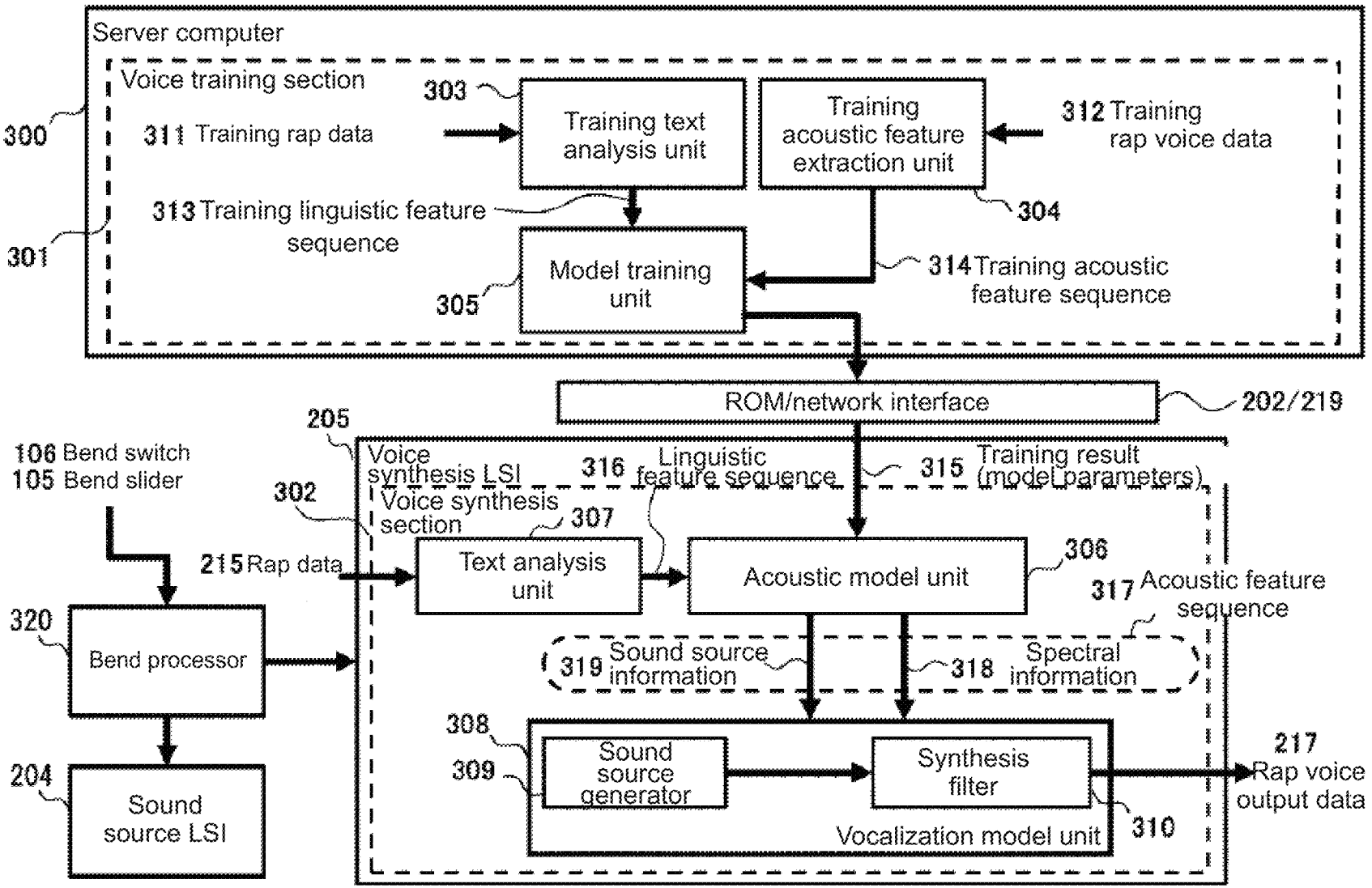
FIG. 3 is a block diagram illustrating primary functionality of the embodiments.

FIG. 3 is a block diagram illustrating primary functionality of the present embodiment. The voice synthesis section 302 is built into the electronic keyboard instrument 100 as part of functionality performed by the voice synthesis LSI 205 in FIG. 2. The voice synthesis section 302 is input with rap data 215 instructed by the CPU 201 in FIG. 2 in accordance with rap playback processing, described later. With this, the voice synthesis section 302 synthesizes and outputs rap voice output data 217.

As illustrated in FIG. 3, the voice training section 301 may, for example, be implemented as part of functionality performed by a separate server computer 300 provided outside the electronic keyboard instrument 100 in FIG. 1. Alternatively, although not illustrated in FIG. 3, if the voice synthesis LSI 205 in FIG. 2 has spare processing capacity, the voice training section 301 may be built into the electronic keyboard instrument 100 and implemented as part of functionality performed by the voice synthesis LSI 205. The sound source LSI 204 is as illustrated in FIG. 2.

Bend processor 320 is functionality whereby the CPU 201 in FIG. 2 executes a program to perform bend-curve-setting processing (see FIG. 11) and bend processing (see FIG. 14), described later. The bend processor 320 performs processing that applies a change to a bend curve (intonation pattern) for, e.g., the pitch of a rap voice using states of the bend sliders 105 and the bend switches 106 illustrated in FIGS. 1 and 2 from the key scanner 206 illustrated in FIG. 2 received via the system bus 209.

The voice training section 301 and the voice synthesis section 302 in FIG. 2 are implemented on the basis of, for example, the "statistical parametric speech synthesis based on deep learning" techniques described in Non-Patent Document 1, cited below.

Non-Patent Document 1

Kei Hashimoto and Shinji Takaki, "Statistical parametric speech synthesis based on deep learning", Journal of the Acoustical Society of Japan, vol. 73, no. 1 (2017), pp. 55-62

The voice training section 301 in FIG. 2, which is functionality performed by the external server computer 300 illustrated in FIG. 3, for example, includes a training text analysis unit 303, a training acoustic feature extraction unit 304, and a model training unit 305.

The voice training section 301, for example, uses voice sounds that were recorded when a given rap singer sang a plurality of rap songs as training rap voice data 312. Lyric text for each rap song is also prepared as training rap data 311.

The training text analysis unit 303 is input with training rap data 311, including lyric text, and the training text analysis unit 303 analyzes this data. The training text analysis unit 303 accordingly estimates and outputs a training linguistic feature sequence 313, which is a discrete numerical sequence expressing, inter alia, phonemes and pitches corresponding to the training rap data 311.

In addition to this input of training rap data 311, the training acoustic feature extraction unit 304 receives and analyzes training rap voice data 312 that was recorded via a microphone or the like when a given rap singer sang lyric text corresponding to the training rap data 311. The training acoustic feature extraction unit 304 accordingly extracts and outputs a training acoustic feature sequence 314 representing phonetic features corresponding to the training rap voice data 312.

The model training unit 305 uses machine learning to estimate an acoustic model with which the probability that a training acoustic feature sequence 314 will be generated given a training linguistic feature sequence 313 and an acoustic model is maximized. In other words, a relationship between a linguistic feature sequence (text) and an acoustic feature sequence (voice sounds) is expressed using a statistical model, which here is referred to as an acoustic model.

The model training unit 305 outputs, as training result 315, model parameters expressing the acoustic model that have been calculated through the employ of machine learning.

As illustrated in FIG. 3, the training result 315 (model parameters) may, for example, be stored in the ROM 202 of the control system in FIG. 2 for the electronic keyboard instrument 100 in FIG. 1 when the electronic keyboard instrument 100 is shipped from the factory, and may be loaded into the acoustic model unit 306, described later, in the voice synthesis LSI 205 from the ROM 202 in FIG. 2 when the electronic keyboard instrument 100 is powered on. Alternatively, as illustrated in FIG. 3, as a result of performer operation of the second switch panel 103 on the electronic keyboard instrument 100, the training result 315 may, for example, be downloaded from the Internet, a universal serial bus (USB) cable, or other network via a non-illustrated network interface 219 and into the acoustic model unit 306, described later, in the voice synthesis LSI 205.

The voice synthesis section 302, which is functionality performed by the voice synthesis LSI 205, includes a text analysis unit 307, the acoustic model unit 306, and a vocalization model unit 308. The voice synthesis section 302 performs statistical voice synthesis processing in which rap voice output data 217, corresponding to rap data 215 including lyric text, is synthesized by making predictions using a statistical model, which here is the acoustic model set in the acoustic model unit 306.

As a result of a performance by a performer made in concert with an automatic performance, the text analysis unit 307 is input with rap data 215, which includes information relating to phonemes, pitches, and the like for lyrics specified by the CPU 201 in FIG. 2, and the text analysis unit 307 analyzes this data. The text analysis unit 307 performs this analysis and outputs a linguistic feature sequence 316 expressing, inter alia, phonemes, parts of speech, and words corresponding to the rap data 215.

The acoustic model unit 306 is input with the linguistic feature sequence 316, and using this, the acoustic model unit 306 estimates and outputs an acoustic feature sequence 317 corresponding thereto. In other words, the acoustic model unit 306 estimates a value for an acoustic feature sequence 317 at which the probability that an acoustic feature sequence 317 will be generated based on a linguistic feature sequence 316 input from the text analysis unit 307 and an acoustic model set using the training result 315 of machine learning performed in the model training unit 305 is maximized.

The vocalization model unit 308 is input with the acoustic feature sequence 317. With this, the vocalization model unit 308 generates rap voice output data 217 corresponding to the rap data 215 including lyric text specified by the CPU 201. The rap voice output data 217 is output from the D/A converter 212, goes through the mixer 213 and the amplifier 214 in FIG. 2, and is emitted from the non-illustrated speaker.

The acoustic features expressed by the training acoustic feature sequence 314 and the acoustic feature sequence 317 include spectral information that models the vocal tract of a person, and sound source information that models the vocal cords of a person. A mel-cepstrum, line spectral pairs (LSP), or the like may be employed as spectral parameters. A power value and a fundamental frequency (F0) indicating the pitch frequency of the voice of a person may be employed as the sound source information. The vocalization model unit 308 includes a sound source generator 309 and a synthesis filter 310. The sound source generator 309 models the vocal cords of a person, and is sequentially input with a sound source information 319 sequence from the acoustic model unit 306. Thereby, the sound source generator 309, for example, generates a sound source signal that is made up of a pulse train (for voiced phonemes) that periodically repeats with a fundamental frequency (F0) and power value contained in the sound source information 319, that is made up of white noise (for unvoiced phonemes) with a power value contained in the sound source information 319, or that is made up of a signal in which a pulse train and white noise are mixed together. The synthesis filter 310 models the vocal tract of a person. The synthesis filter 310 forms a digital filter that models the vocal tract on the basis of a spectral information 318 sequence sequentially input thereto from the acoustic model unit 306, and using the sound source signal input from the sound source generator 309 as an excitation signal, generates and outputs rap voice output data 217 in the form of a digital signal.

The sampling frequency of the training rap voice data 312 is, for example, 16 kHz (kilohertz). When a mel-cepstrum parameter obtained through mel-cepstrum analysis, for example, is employed for a spectral parameter contained in the training acoustic feature sequence 314 and the acoustic feature sequence 317, the frame update period is, for example, 5 msec (milliseconds). In addition, when mel-cep strum analysis is performed, the length of the analysis window is 25 msec, and the window function is a twenty-fourth-order Blackman window function.

Next, a first embodiment of statistical voice synthesis processing performed by the voice training section 301 and the voice synthesis section 302 in FIG. 3 will be described. In the first embodiment of statistical voice synthesis processing, hidden Markov models (HMMs), described in Non-Patent Document 1 above and Non-Patent Document 2 below, are used for acoustic models expressed by the training result 315 (model parameters) set in the acoustic model unit 306.

Non-Patent Document 2

Shinji Sako, Keijiro Saino, Yoshihiko Nankaku, Keiichi Tokuda, and Tadashi Kitamura, "A trainable singing voice synthesis system capable of representing personal characteristics and singing styles", Information Processing Society of Japan (IPSJ) Technical Report, Music and Computer (MUS) 2008 (12 (2008-MUS-074)), pp. 39-44, 2008 Feb. 8

In the first embodiment of statistical voice synthesis processing, when a user vocalizes lyrics in accordance with a given melody, HMM acoustic models are trained on how rap voice feature parameters, such as vibration of the vocal cords and vocal tract characteristics, change over time during vocalization. More specifically, the HMM acoustic models model, on a phoneme basis, spectrum and fundamental frequency (and the temporal structures thereof) obtained from the training rap data.

Next, a second embodiment of the statistical voice synthesis processing performed by the voice training section 301 and the voice synthesis section 302 in FIG. 3 will be described. In the second embodiment of statistical voice synthesis processing, in order to predict an acoustic feature sequence 317 from a linguistic feature sequence 316, the acoustic model unit 306 is implemented using a deep neural network (DNN). Correspondingly, the model training unit 305 in the voice training section 301 learns model parameters representing non-linear transformation functions for neurons in the DNN that transform linguistic features into acoustic features, and the model training unit 305 outputs, as the training result 315, these model parameters to the DNN of the acoustic model unit 306 in the voice synthesis section 302.

Figure 4:
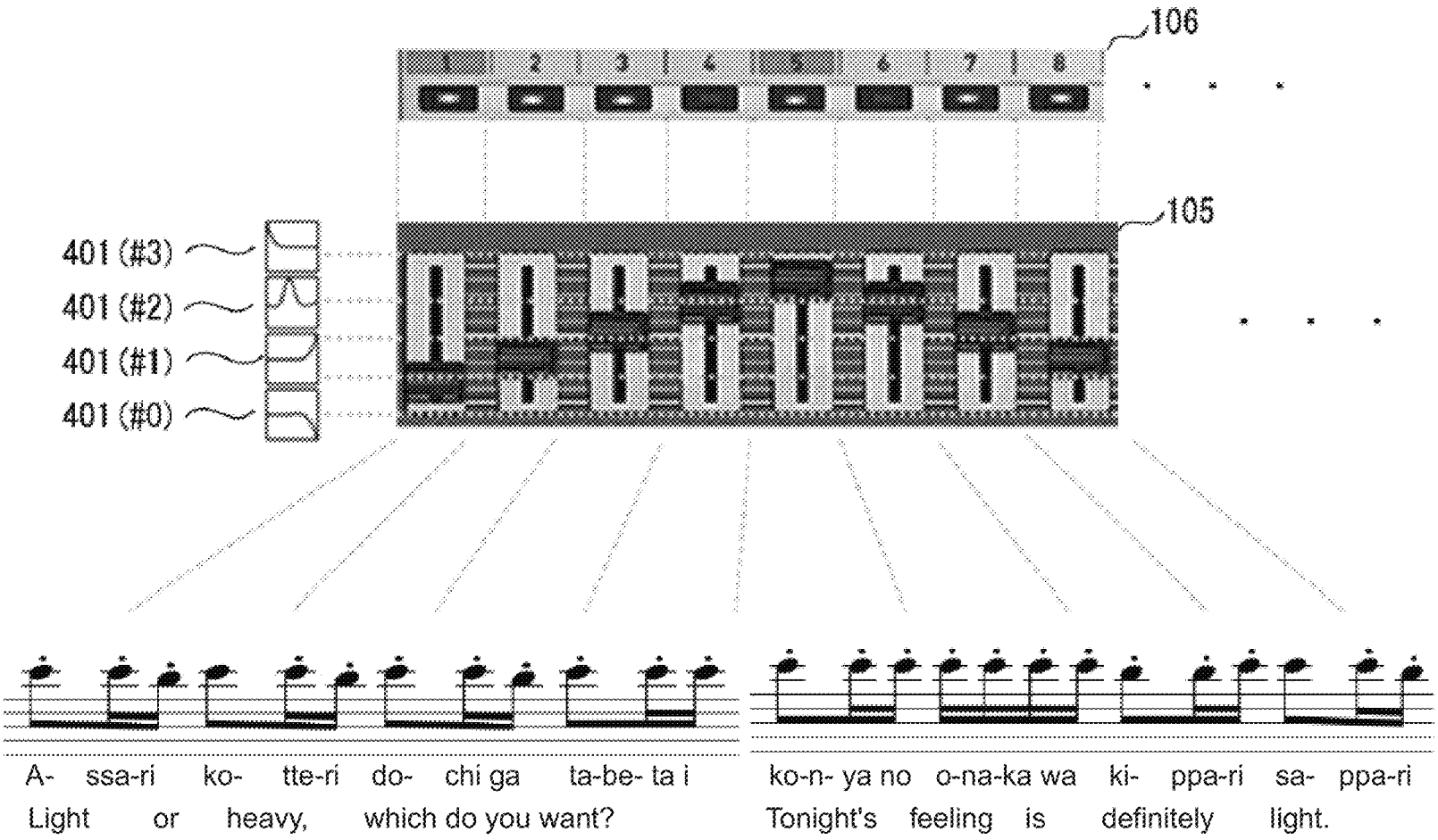
FIG. 4 is a diagram for explaining bend sliders, bend switches, and a bend curve specification operation of the embodiments.

Detailed description follows regarding operation for the automatic performance of songs, including rap, in embodiments of the electronic keyboard instrument 100 of FIGS. 1 and 2 in which the statistical voice synthesis processing described with reference to FIG. 3 is employed. FIG. 4 is a diagram for explaining a bend curve specification operation of the present embodiments using the bend sliders 105 and the bend switches 106 in FIGS. 1 and 2. In the present embodiments, a bend curve can be specified for each, e.g., beat (a prescribed unit of progression) in a rap song that is progressing automatically. A bend curve is an intonation pattern for pitches in the rap that changes over the duration of each beat.

The specification of a bend curve and the application of a bend based thereon can be performed by a user in real time in a rap song that is progressing automatically using the volumes of the bend sliders 105 illustrated in FIG. 4, which function as a specification unit, for each of, e.g., 16 consecutive beats (four measures in the case of a song with a 4/4 time signature). The bend sliders 105 include, for example, 16 (only eight are illustrated in the example in FIG. 4) sliders. In order from left to right, the sliders are able to specify the type of bend curve for each of the upcoming 16 beats to be performed in the rap song that is currently progressing automatically. Multiple types of bend curve patterns 401 may be prepared as bend curves able to be specified (the example in FIG. 4 depicts four bend curve patterns 401, #0 to #3, at the left side of the bend sliders 105). Using the slide position of each slider, the user can specify one of the plurality of bend curve patterns 401 for each of the 16 sliders of the bend sliders 105.

The bend switches 106, which function as a specification unit and are for example made up of 16 switches, are disposed above the bend sliders 105, which are for example made up of 16 sliders. Each switch of the bend switches 106 corresponds to the slider of the bend sliders 105 that is disposed directly therebelow. For any of the 16 beats, the user is able to disable the corresponding slider setting in the bend sliders 105 by turning OFF the corresponding switch in the bend switches 106. It is thereby possible to make it so that there is no bend effect on that beat.

The bend curve setting made for each of the 16 consecutive beats using the bend sliders 105 and the bend switches 106 is received by the bend processor 320 described in FIG. 3. During the automatic performance of a rap song progressing automatically in the voice synthesis section 302 (see FIGS. 2 and 3), the bend processor 320, which acts as an application unit, designates, with respect to the voice synthesis section 302, an intonation for the pitch of a rap voice corresponding to the bend curve that has been specified using the bend sliders 105 and the bend switches 106 for each beat of 16 consecutive beats (for four measures in the case of a 4/4 time signature).

Specifically, as each beat progresses, the bend processor 320 specifies, with respect to the voice synthesis section 302, pitch change information on the basis of the bend curve that is specified for that beat. The temporal resolution of pitch bends in one beat is, for example, 48. In this case, the bend processor 320 specifies, with respect to the voice synthesis section 302, and so pitch change information corresponding to the specified bend curve at timings obtained by dividing one beat by 48. The voice synthesis section 302 described in FIG. 3 changes the pitch of sound source information 319 output from the acoustic model unit 306 on the basis of pitch change information specified by the bend processor 320, and supplies the changed sound source information 319 to the sound source generator 309.

In this manner, in the present embodiments, the lyrics and temporal progression, for example, of a rap song are left to be automatically performed, making it possible for the user to specify bend curve intonation patterns for rap-like pitches, for example, per each unit of progression (e.g., beat), and making it possible for the user to freely enjoy rap performances.

In particular, in this case, using the bend sliders 105 and bend switches 106 corresponding to each of, e.g., 16 beats, the user is able to specify, in real time, a bend curve for realizing a rap voice pitch at each beat per every 16 beats in an automatic performance that is progressing automatically, making it possible for the user to put on their own rap performance as the rap song is performed automatically.

The specification of a bend curve for each beat, for example, may be performed by a user in advance and stored in association with a rap song to be automatically performed such that when the rap song is automatically performed, the bend processor 320 loads the specified bend curves and designates, with respect to the voice synthesis section 302, intonations for the pitch of the rap voice corresponding to the bend curve that has been specified.

Thereby, users are able to apply intonation to the pitch of a rap voice in a rap song in a deliberate manner.

Incidentally, the number of segments in voice data (which encompasses various forms of data, such as musical piece data, lyric data, and text data) is typically greater than the number of the plurality of operation elements (sliding operation elements 105). For this reason, the processor 201 performs processing in which, after the output of first segment data that was associated with a first operation element, segment data associated with the first operation element is changed from first segment data to segment data that comes after the first segment data.

Suppose that the number of the plurality of operation elements (sliding operation elements 105) was equal to eight. In this case, the processor 201 would, at a given timing, associate the plurality of operation elements with, for example, segments of voice data that are two measures long. In other words, at a given timing, the plurality of operation elements are given associations as follows:

First operation element . . . first segment data (segment for the first beat in a first measure)

Second operation element . . . second segment data (segment for the second beat in the first measure)

Third operation element . . . third segment data (segment for the third beat in the first measure)

Fourth operation element . . . fourth segment data (segment for the fourth beat in the first measure)

Fifth operation element . . . fifth segment data (segment for the first beat in a second measure)

Sixth operation element . . . sixth segment data (segment for the second beat in the second measure)

Seventh operation element . . . seventh segment data (segment for the third beat in the second measure)

Eighth operation element . . . eighth segment data (segment for the fourth beat in the second measure)

After the keyboard instrument outputs first segment data that was associated with the first operation element, the processor 201 performs processing in which segment data associated with the first operation element is changed from first segment data to ninth segment data that follows the eighth segment data (for example, a segment for the first beat in a third measure).

In other words, during a performance, segment data allocated to a first operation element is successively changed in the manner: first segment data→ninth segment data→$17^{th}$ segment data, and so on. That is, for example, at a timing at which the production of a singing voice up to the fourth beat in the first measure ends, segment data allocated to the operation elements is as follows:

First operation element . . . ninth segment data (segment for the first beat in a third measure)

Second operation element . . . $10^{th}$ segment data (segment for the second beat in the third measure)

Third operation element . . . $11^{th}$ segment data (segment for the third beat in the third measure)

Fourth operation element . . . $12^{th}$ segment data (segment for the fourth beat in the third measure)

Fifth operation element . . . 13th segment data (segment for the first beat in a fourth measure)

Sixth operation element . . . 14th segment data (segment for the second beat in the fourth measure)

Seventh operation element . . . 15th segment data (segment for the third beat in the fourth measure)

Eighth operation element . . . 16th segment data (segment for the fourth beat in the fourth measure)

An advantage of the present invention is that despite having only a limited number of operation elements, during a performance, because the segment of voice data allocated to a single operation element changes, the voice data is able to be sung in a satisfactory manner no matter what the length of the voice data.

Combinations of intonation patterns allocated to respective operation elements, for example, a combination of intonation patterns in which intonation pattern 401 (#0) (a first pattern) is allocated to the first operation element and intonation pattern 401 (#1) (a second pattern) is allocated to the second operation element, also do not change so long as the operation elements 105 are not operated. Accordingly, once a combination of intonation patterns has been determined by operation of the operation elements 105, even if the user does not subsequently operate the operation elements 105, the keyboard instrument is able to produce sound using the determined combination of intonation patterns from the start to the end of the voice data. In other words, during a performance in which the keyboard 101 is operated by the user, it is not necessary to operate the operation elements 105 to apply intonation to a singing voice. This has the advantage of enabling the user to concentrate on operation of the keyboard 101.

The combination of intonation patterns is of course able to be changed at any time in the middle of a performance if the user operates the operation elements 105. In other words, during a performance in which the keyboard 101 is operated by the user, combinations of intonation patterns can be changed in concert with changes in expression in the performance. This has the advantage of enabling the user to continue performing in an enjoyable manner.

In the example of FIG. 4, each of the plurality of operation elements 105 is, for example, a sliding operation element 105. In this case, the processor 201 makes a determination as to an intonation pattern from among a plurality of preset intonation patterns on the basis of data indicating an amount of slider operation that is acquired in accordance with a slide operation on the sliding operation elements 105 by the user. If the operation elements 105 are rotating operation elements 105, the intonation pattern would be determined on the basis of data indicating an amount of rotation. Further, if the operation elements 105 are button operation elements 105, the intonation pattern would be determined according to whether a button is ON or OFF.

In the present example, a singing voice is synthesized on the basis of pitch data that has been specified through operation of the keyboard 101 by the user. In other words, singing voice data that corresponds to a lyric and a specified pitch is generated in real time.

FIG. 5 is a diagram illustrating, for the present embodiments, an example data configuration for musical piece data loaded into the RAM 203 from the ROM 202 in FIG. 2. This example data configuration conforms to the Standard MIDI (Musical Instrument Digital Interface) File format, which is one file format used for MIDI files.

The musical piece data is configured by data blocks called "chunks". Specifically, the musical piece data is configured by a header chunk at the beginning of the file, a first track chunk that comes after the header chunk and stores lyric data for a lyric part, and a second track chunk that stores performance data for an accompaniment part.

The header chunk is made up of five values: ChunkID, ChunkSize, FormatType, NumberOfTrack, and TimeDivision. ChunkID is a four byte ASCII code "4D 54 68 64" (in base 16) corresponding to the four half-width characters "MThd", which indicates that the chunk is a header chunk. ChunkSize is four bytes of data that indicate the length of the FormatType, NumberOfTrack, and TimeDivision part of the header chunk (excluding ChunkID and ChunkSize). This length is always "00 00 00 06" (in base 16), for six bytes. FormatType is two bytes of data "00 01" (in base 16). This indicates that in the case of the present embodiments, the format type is format 1, in which multiple tracks are used. NumberOfTrack is two bytes of data "00 02" (in base 16). This indicates that in the case of the present embodiments, two tracks, corresponding to the lyric part and the accompaniment part, are used. TimeDivision is data indicating a timebase value, which itself indicates resolution per quarter note. TimeDivision is two bytes of data "01 E0" (in base 16). In the case of the present embodiments, this indicates 480 in decimal notation.

The first and second track chunks are each made up of a ChunkID, ChunkSize, and performance data pairs. The performance data pairs are made up of DeltaTime_1[i] and Event_1[i] (for the first track chunk/lyric part), or DeltaTime_2[i] and Event_2[i] (for the second track chunk/accompaniment part). Note that $0 \leq i \leq L$ for the first track chunk/lyric part, and $0 \leq i \leq M$ for the second track chunk/accompaniment part. ChunkID is a four byte ASCII code "4D 54 72 6B" (in base 16) corresponding to the four half-width characters "MTrk", which indicates that the chunk is a track chunk. ChunkSize is four bytes of data that indicate the length of the respective track chunk (excluding ChunkID and ChunkSize).

DeltaTime_1[i] is variable-length data of one to four bytes indicating a wait time (relative time) from the execution time of Event_1[i−1] immediately prior thereto. Similarly, DeltaTime_2[i] is variable-length data of one to four bytes indicating a wait time (relative time) from the execution time of Event_2[i−1] immediately prior thereto. Event_1[i] is a meta event designating the vocalization timing and pitch of a rap lyric in the first track chunk/lyric part. Event_2[i] is a MIDI event designating "note on" or "note off" or is a meta event designating time signature in the second track chunk/accompaniment part. In each DeltaTime_1[i] and Event_1[i] performance data pair of the first track chunk/lyric part, Event_1[i] is executed after a wait of DeltaTime_1[i] from the execution time of the Event_1[i−1] immediately prior thereto. The vocalization and progression of lyrics is realized thereby. In each DeltaTime_2[i] and Event_2[i] performance data pair of the second track chunk/accompaniment part, Event_2[i] is executed after a wait of DeltaTime_2[i] from the execution time of the Event_2[i−1] immediately prior thereto. The progression of automatic accompaniment is realized thereby.

FIG. 6 is a diagram illustrating an example data configuration in a bend curve settings table 600 that stores bend curve settings for each beat specified using the bend sliders 105, the bend switches 106 (see FIGS. 1, 2, and 4), and the bend processor 320 (see FIG. 3). The bend curve settings table 600 is, for example, stored in the RAM 203 in FIG. 2. For every 16 consecutive beats, the bend curve settings table 600, stores measure numbers, beat numbers, and specified bend curve numbers. For example, data group 601 (#0), which is the first 16 consecutive beats, stores measure numbers 0-3, beat numbers 0-3 for each measure, and bend curve numbers 0-3 (corresponding to 401 (#0)-401 (#3) in FIG. 4). The bend curve number of beats that have been marked OFF using the bend switches 106 is set to a null value (depicted as "-" in FIG. 6).

FIG. 7 is a diagram illustrating a bend curve table 700 that stores bend curves for, e.g., four patterns corresponding to the intonation patterns of bend curves corresponding to 401 (#0)-401 (#3) in FIG. 4. The bend curve table 700 is, for example, stored in the ROM 202 in FIG. 2 in the form of factory settings. In FIGS. 7, 401 (#0), 401 (#1), 401 (#2), and 401 (#3) each correspond to one of the bend curve patterns illustrated in FIG. 4, and, for example, the respective beginning storage address thereof in the ROM 202 are BendCurve[0], BendCurve[1], BendCurve[2], and BendCurve[3]. R is the resolution of bend curves, and, for example, R=48. An address offset in each bend curve indicates an offset value from the respective beginning storage address. Each offset value from 0 to R−1 (e.g., 0-47) has a storage area, and a bend value is stored in each of these storage areas. The bend values are multipliers for values of pitches prior to being changed. For example, a value of "1.00" indicates that pitch will not be changed, and a value of "2.00" indicates that pitch will be doubled.

Figure 8:
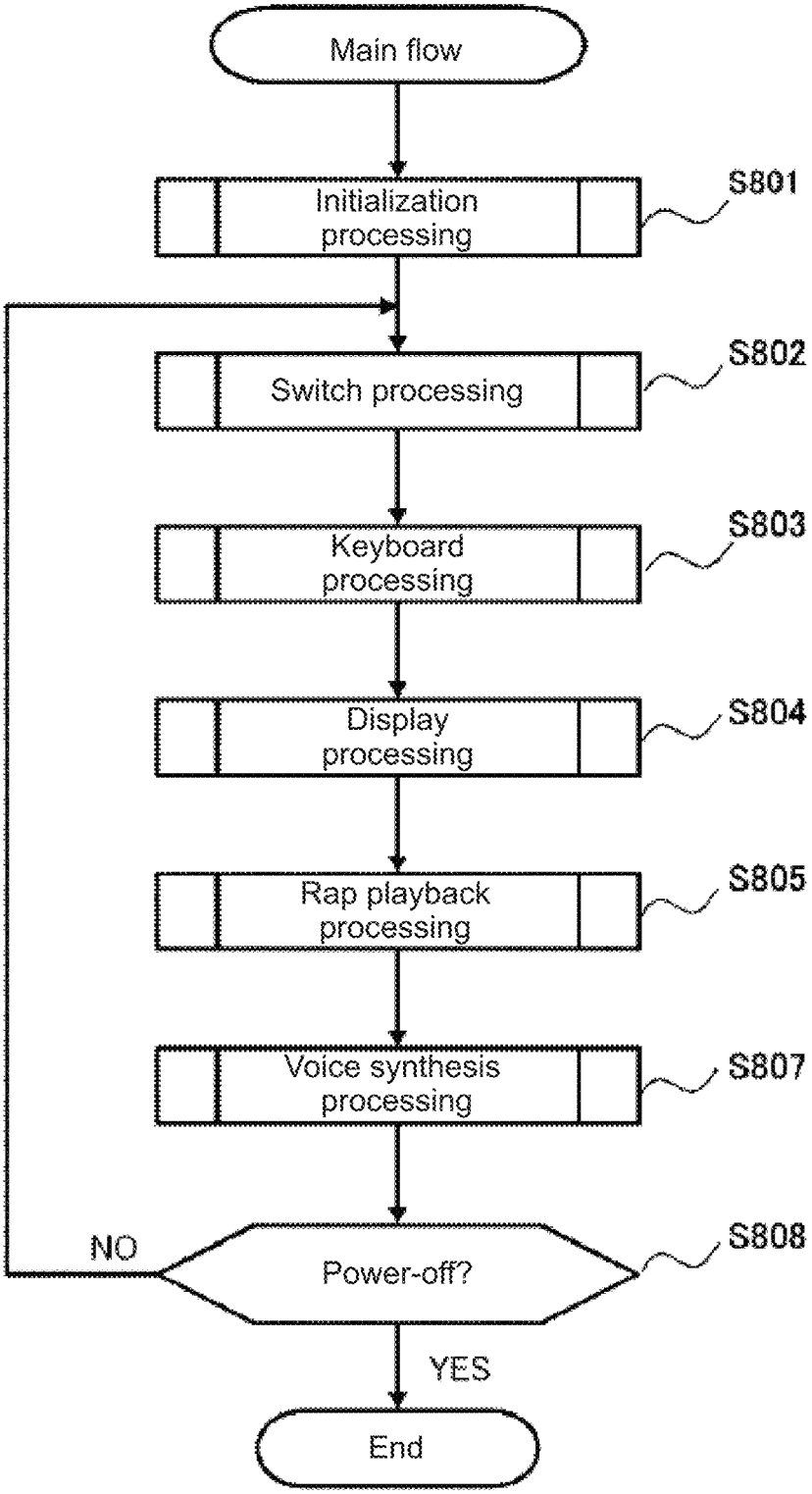
FIG. 8 is a main flowchart illustrating an example of a control process for the electronic musical instrument of the present embodiments.

FIG. 8 is a main flowchart illustrating an example of a control process for the electronic musical instrument of the present embodiments. For this control process, for example, the CPU 201 in FIG. 2 executes a control processing program loaded into the RAM 203 from the ROM 202.

After first performing initialization processing (step S801), the CPU 201 repeatedly performs the series of processes from step S802 to step S808.

In this repeat processing, the CPU 201 first performs switch processing (step S802). Here, based on an interrupt from the key scanner 206 in FIG. 2, the CPU 201 performs processing corresponding to the operation of a switch on the first switch panel 102, the second switch panel 103, a bend slider 105, or a bend switch 106 in FIG. 1.

Next, based on an interrupt from the key scanner 206 in FIG. 2, the CPU 201 performs keyboard processing (step S803) that determines whether or not any of the keys on the keyboard 101 in FIG. 1 have been operated, and proceeds accordingly. Here, in response to an operation by a performer pressing or releasing any of the keys, the CPU 201 outputs musical sound control data 216 instructing the sound source LSI 204 in FIG. 2 to start generating sound or to stop generating sound.

Next, the CPU 201 processes data that should be displayed on the LCD 104 in FIG. 1, and performs display processing (step S804) that displays this data on the LCD 104 via the LCD controller 208 in FIG. 2. Examples of the data that is displayed on the LCD 104 include lyrics corresponding to the rap voice output data 217 being performed, the musical score for the melody corresponding to the lyrics, and information relating to various settings.

Next, the CPU 201 performs rap playback processing (step S805). In this processing, the CPU 201 performs a control process described in FIG. 5 on the basis of a performance by a performer, generates rap data 215, and outputs this data to the voice synthesis LSI 205.

Then, the CPU 201 performs sound source processing (step S806). In the sound source processing, the CPU 201 performs control processing such as that for controlling the envelope of musical sounds being generated in the sound source LSI 204.

Finally, the CPU 201 determines whether or not a performer has pressed a non-illustrated power-off switch to turn off the power (step S807). If the determination of step S807 is NO, the CPU 201 returns to the processing of step S802. If the determination of step S807 is YES, the CPU 201 ends the control process illustrated in the flowchart of FIG. 8 and powers off the electronic keyboard instrument 100.

Figure 9A:
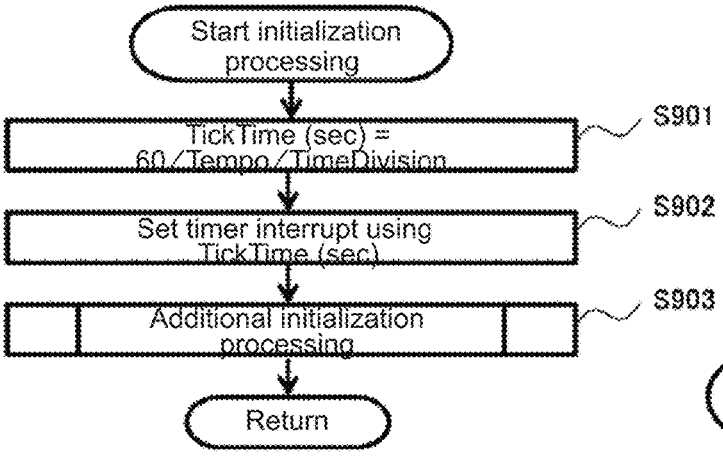
FIGS. 9A, 9B, and 9C depict flowcharts illustrating detailed examples of initialization processing, tempo-changing processing, and rap-starting processing, respectively.
Figure 9B:
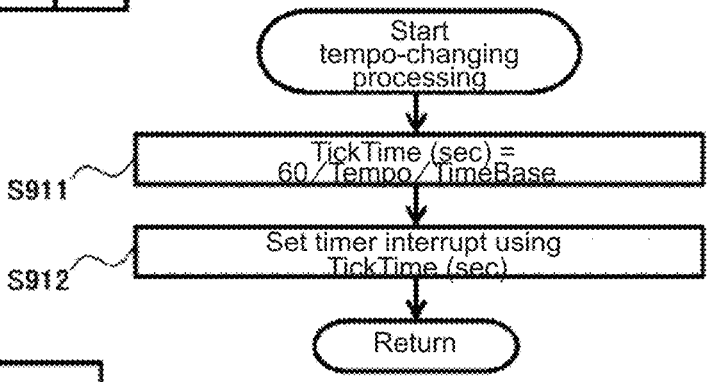
Figure 9C:
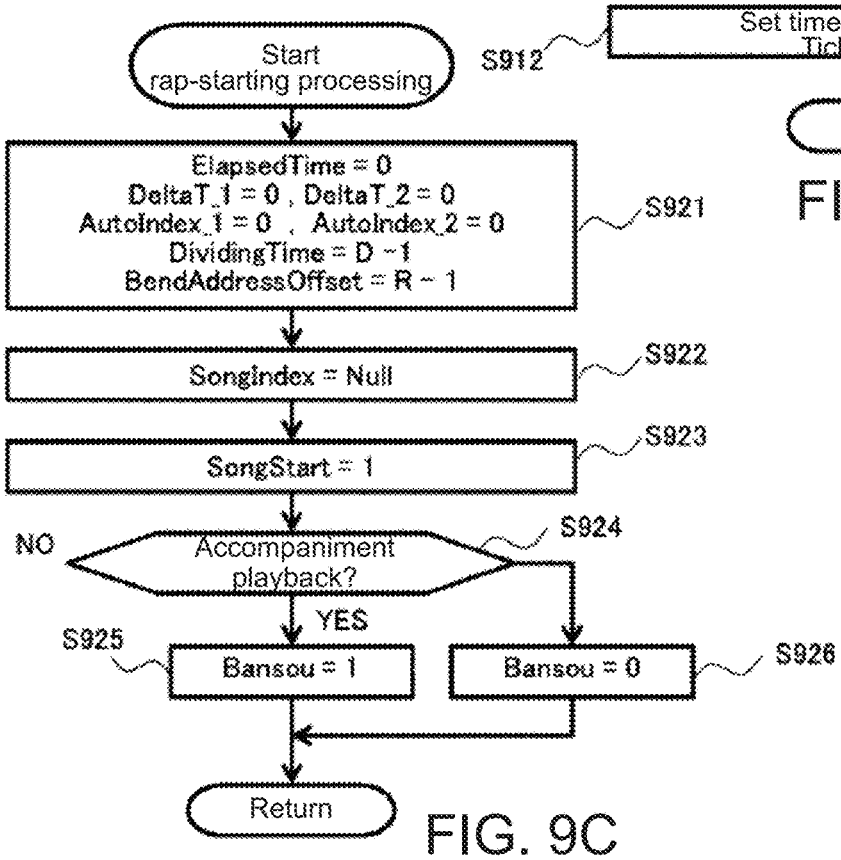

FIGS. 9A to 9C are flowcharts respectively illustrating detailed examples of the initialization processing at step S801 in FIG. 8; tempo-changing processing at step S1002 in FIG. 10, described later, during the switch processing of step S802 in FIG. 8; and similarly, rap-starting processing at step S1006 in FIG. 10, described later, during the switch processing of step S802 in FIG. 8.

First, in FIG. 9A, which illustrates a detailed example of the initialization processing at step S801 in FIG. 8, the CPU 201 performs TickTime initialization processing. In the present embodiment, the progression of lyrics and automatic accompaniment progress in a unit of time called TickTime.

The timebase value, specified as the TimeDivision value in the header chunk of the musical piece data in FIG. 5, indicates resolution per quarter note. If this value is, for example, 480, each quarter note has a duration of 480 TickTime. The DeltaTime_1[i] values and the DeltaTime_2[i] values, indicating wait times in the track chunks of the musical piece data in FIG. 5, are also counted in units of TickTime. The actual number of seconds corresponding to 1 TickTime differs depending on the tempo specified for the musical piece data. Taking a tempo value as Tempo (beats per minute) and the timebase value as TimeDivision, the number of seconds per unit of TickTime is calculated using Equation (1) below.

$$\text{TickTime(sec)}=60/\text{Tempo}/\text{TimeDivision} \quad (1)$$

Accordingly, in the initialization processing illustrated in the flowchart of FIG. 9A, the CPU 201 first calculates TickTime (sec) by an arithmetic process corresponding to Equation (1) (step S901). A prescribed initial value for the tempo value Tempo, e.g., 60 (beats per second), is stored in the ROM 202 in FIG. 2. Alternatively, the tempo value from when processing last ended may be stored in non-volatile memory.

Next, the CPU 201 sets a timer interrupt for the timer 210 in FIG. 2 using the TickTime (sec) calculated at step S901 (step S902). A CPU 201 interrupt for lyric progression, automatic accompaniment, and bend processing (referred to below as an "automatic-performance interrupt") is thus generated by the timer 210 every time the TickTime (sec) has elapsed. Accordingly, in automatic-performance interrupt processing (FIG. 12, described later) performed by the CPU 201 based on an automatic-performance interrupt, processing to control lyric progression and the progression of automatic accompaniment is performed every 1 TickTime.

Bend processing, described later, is performed in units of time obtained by multiplying 1 TickTime by D. D is calculated according to Equation (2) below. This equation uses the timebase value TimeDivision indicating resolution per quarter note, described in FIG. 3, and the resolution R of the bend curve table 700 described in FIG. 7.

$$D=\text{TimeDivision}/R \quad (2)$$

As in the foregoing, if, for example, each quarter note (one beat in the case of a 4/4 time signature) is equal to 480 TickTime and R=48, bend processing would be performed every D=480/R=480/48=10 TickTime.

Then, the CPU 201 performs additional initialization processing, such as that to initialize the RAM 203 in FIG. 2 (step S903). The CPU 201 subsequently ends the initialization processing at step S801 in FIG. 8 illustrated in the flowchart of FIG. 9A.

The flowcharts in FIGS. 9B and 9C will be described later. FIG. 10 is a flowchart illustrating a detailed example of the switch processing at step S802 in FIG. 8.

First, the CPU 201 determines whether or not the tempo of lyric progression and automatic accompaniment has been changed using a switch for changing tempo on the first switch panel 102 in FIG. 1 (step S1001). If this determination is YES, the CPU 201 performs tempo-changing processing (step S1002). The details of this processing will be described later using FIG. 9B. If the determination of step S1001 is NO, the CPU 201 skips the processing of step S1002.

Next, the CPU 201 determines whether or not a rap song has been selected with the second switch panel 103 in FIG. 1 (step S1003). If this determination is YES, the CPU 201 performs rap-song-loading processing (step S1004). In this processing, musical piece data having the data structure described in FIG. 5 is loaded into the RAM 203 from the ROM 202 in FIG. 2. Subsequent data access of the first track chunk or the second track chunk in the data structure illustrated in FIG. 5 is performed with respect to the musical piece data that has been loaded into the RAM 203. If the determination of step S1003 is NO, the CPU 201 skips the processing of step S1004.

Then, the CPU 201 determines whether or not a switch for starting a rap on the first switch panel 102 in FIG. 1 has been operated (step S1005). If this determination is YES, the CPU 201 performs rap-starting processing (step S1006). The details of this processing will be described later using FIG. 9C. If the determination of step S1005 is NO, the CPU 201 skips the processing of step S1006.

Then, the CPU 201 determines whether or not a bend-curve-setting start switch on the first switch panel 102 in FIG. 1 has been operated (step S1007). If this determination is YES, the CPU 201 performs bend-curve-setting processing based on the bend sliders 105 and the bend switches 106 in FIG. 1 (step S1008). The details of this processing will be described later using FIG. 11. If the determination of step S1007 is NO, the CPU 201 skips the processing of step S1008.

Finally, the CPU 201 determines whether or not any other switches on the first switch panel 102 or the second switch panel 103 in FIG. 1 have been operated, and performs processing corresponding to each switch operation (step S1009). The CPU 201 subsequently ends the switch processing at step S802 in FIG. 8 illustrated in the flowchart of FIG. 10.

Figure 10:
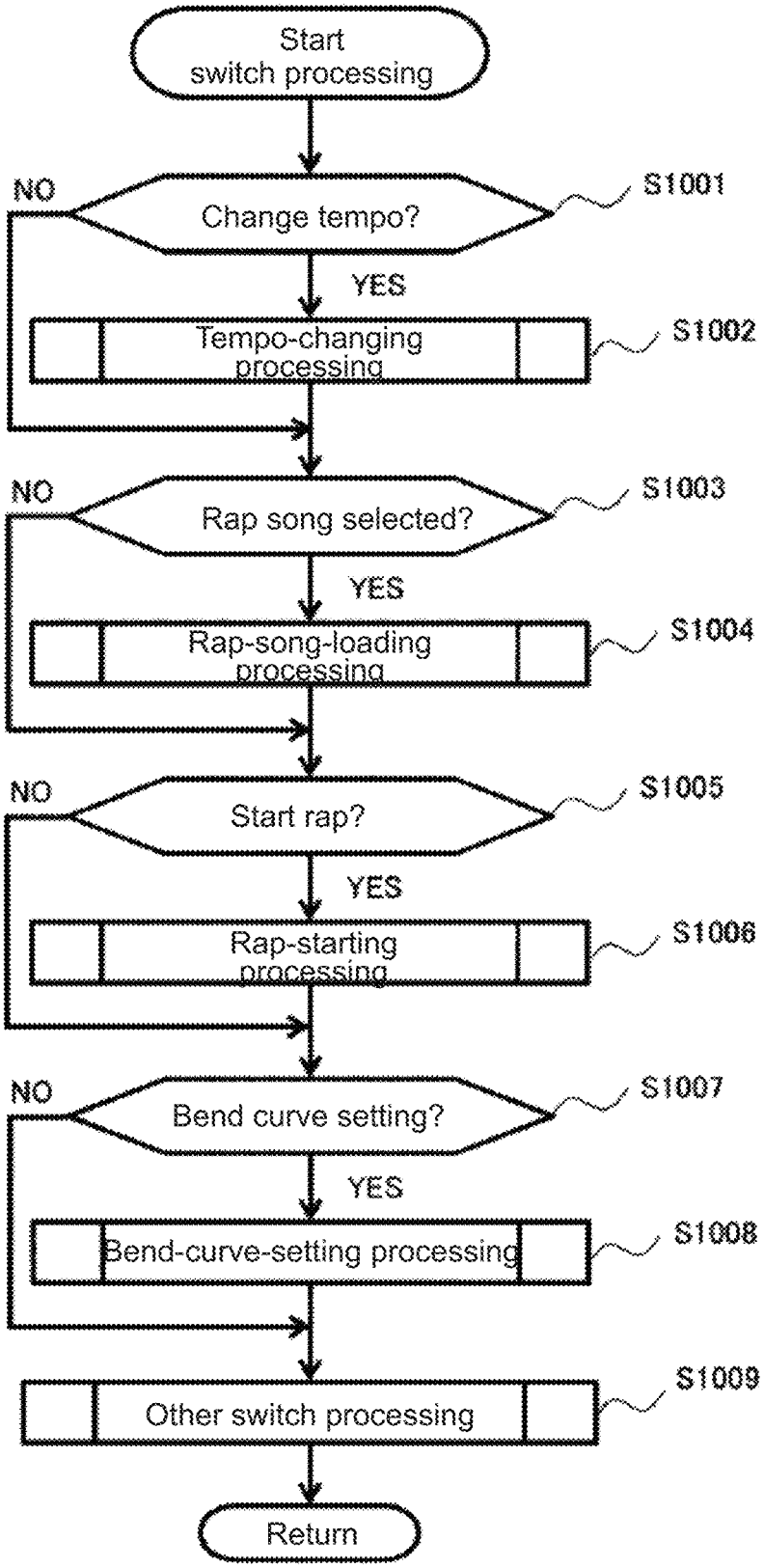
FIG. 10 is a flowchart illustrating a detailed example of switch processing.

FIG. 9B is a flowchart illustrating a detailed example of the tempo-changing processing at step S1002 in FIG. 10. As mentioned previously, a change in the tempo value also results in a change in the TickTime (sec). In the flowchart of FIG. 9B, the CPU 201 performs a control process related to changing the TickTime (sec).

Similarly to at step S901 in FIG. 9A, which is performed in the initialization processing at step S801 in FIG. 8, the CPU 201 first calculates the TickTime (sec) by an arithmetic process corresponding to Equation (1) (step S911). It should be noted that the tempo value Tempo that has been changed using the switch for changing tempo on the first switch panel 102 in FIG. 1 is stored in the RAM 203 or the like.

Next, similarly to at step S902 in FIG. 9A, which is performed in the initialization processing at step S801 in FIG. 8, the CPU 201 sets a timer interrupt for the timer 210 in FIG. 2 using the TickTime (sec) calculated at step S911 (step S912). The CPU 201 subsequently ends the tempo-changing processing at step S1002 in FIG. 10 illustrated in the flowchart of FIG. 9B.

FIG. 9C is a flowchart illustrating a detailed example of the rap-starting processing at step S1006 in FIG. 10.

First, with regards to the progression of an automatic performance, the CPU 201 initializes the value of an ElapseTime variable in the RAM 203 for indicating, in units of TickTime, the amount of time that has elapsed since the start of the automatic performance to 0. The CPU 201 also initializes the values of both a DeltaT_1 (first track chunk) variable and a DeltaT_2 (second track chunk) variable in the RAM 203 for counting, similarly in units of TickTime, relative time since the last event to 0. Next, the CPU 201 initializes the respective values of an AutoIndex_1 variable in the RAM 203 for specifying an i value ($1 \le i \le L-1$) for DeltaTime_1[i] and Event_1[i] performance data pairs in the first track chunk of the musical piece data illustrated in FIG.

5, and an AutoIndex_2 variable in the RAM 203 for specifying an i ($1 \leq i \leq M-1$) for DeltaTime_2[i] and Event_2[i] performance data pairs in the second track chunk of the musical piece data illustrated in FIG. 6, to 0. Using the value of D calculated with Equation (2), the value of a DividingTime variable in the RAM 203 that indicates a time frequency, in units of TickTime, is also set to D−1. Further, using the resolution R described with reference to FIG. 7, the value of a BendAdressOffset variable in the RAM 203 that indicates an offset address in the bend curve table 700, also described with reference to FIG. 7, is initialized to the value R−1. For example, R−1=48−1=47 (the preceding is step S921). Thus, in the example of FIG. 5, the DeltaTime_1[0] and Event_1[0] performance data pair at the beginning of first track chunk and the DeltaTime_2[0] and Event_2[0] performance data pair at the beginning of second track chunk are both referenced to set an initial state.

Next, the CPU 201 initializes the value of a SongIndex variable in the RAM 203, which designates the current rap position, to 0 (step S922).

The CPU 201 also initializes the value of a SongStart variable in the RAM 203, which indicates whether to advance (=1) or not advance (=0) the lyrics and accompaniment, to 1 (advance) (step S923).

Then, the CPU 201 determines whether or not a performer has configured the electronic keyboard instrument 100 to playback an accompaniment together with rap lyric playback using the first switch panel 102 in FIG. 1 (step S924).

If the determination of step S924 is YES, the CPU 201 sets the value of a Bansou variable in the RAM 203 to 1 (has accompaniment) (step S925). Conversely, if the determination of step S924 is NO, the CPU 201 sets the value of the Bansou variable to 0 (no accompaniment) (step S926). After the processing at step S925 or step S926, the CPU 201 ends the rap-starting processing at step S1006 in FIG. 10 illustrated in the flowchart of FIG. 9C.

Figure 11:
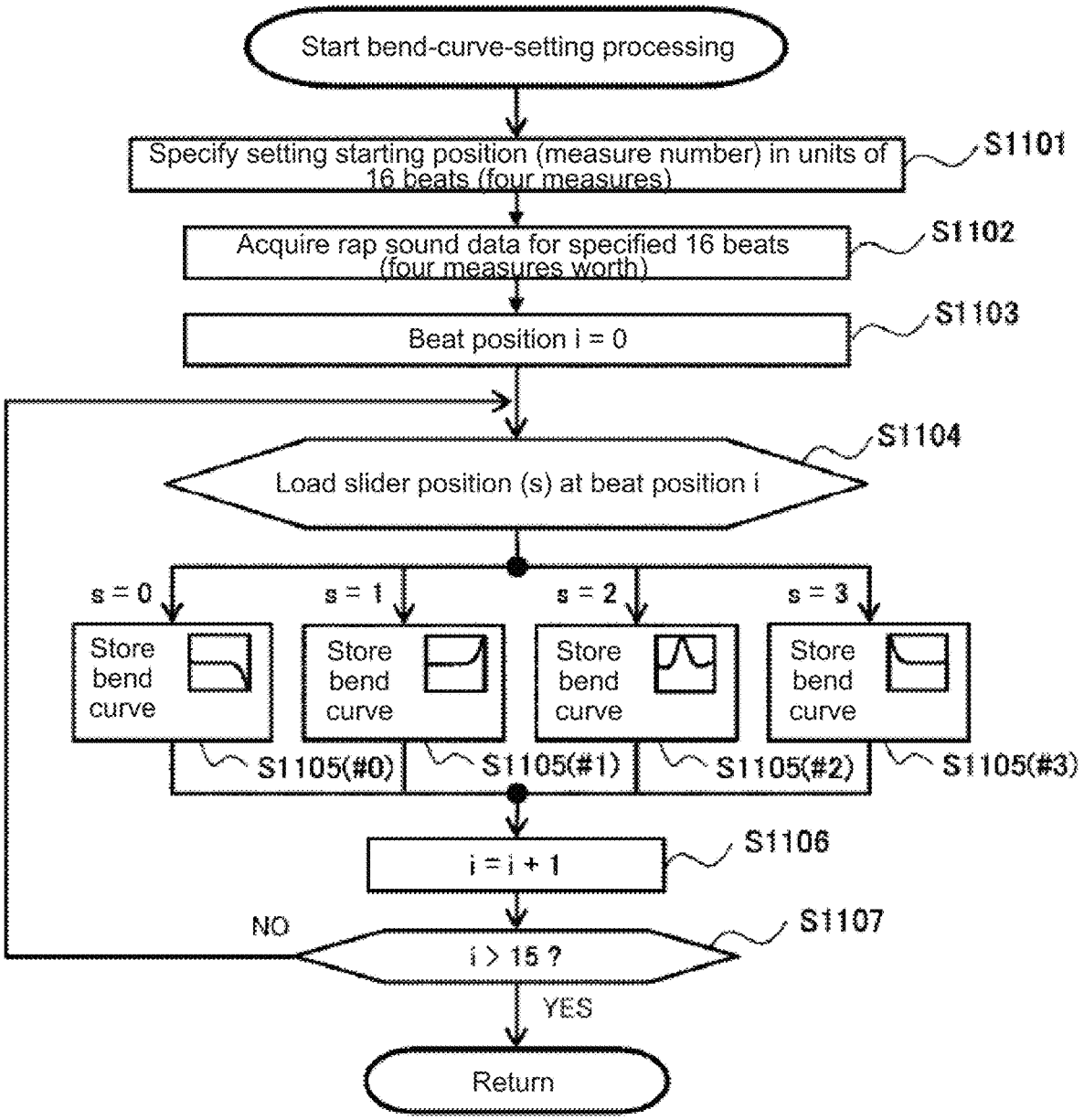
FIG. 11 is a flowchart illustrating a detailed example of bend-curve-setting processing.

FIG. 11 is a flowchart illustrating a detailed example of the bend-curve-setting processing at step S1008 in FIG. 10. First, the CPU 201 specifies setting starting positions (measure numbers) in units of, e.g., 16 beats (four measures in the case of a 4/4 time signature) (step S1101). Because the bend-curve-setting processing is able to be performed in real time with the progression of an automatic performance, if the initial value here is, for example, for the zeroth measure, the process may be configured to sequentially specify the following $16^{th}$ measure, $32^{nd}$ measure, and so on automatically every time a 16 beat setting is completed. In order to change settings for beats that are currently being automatically performed, the user is also able to specify, as the setting starting position, 16 consecutive beats that include beats currently being performed using, for example, a non-illustrated switch on the first switch panel 102.

Next, the CPU 201 acquires rap lyric data for the 16 beats (four measures worth) that were specified in step S1101 from the ROM 202 (step S1102). The CPU 201 can display rap lyric data acquired in this manner on the LCD 104 in FIG. 2, for example, in order to assist user bend curve specification.

Next, the CPU 201 sets an initial value for a beat position in the 16 consecutive beats to 0 (step S1103).

Then, after initializing, to 0, the value of a variable i in the RAM 203 that indicates beat position in the 16 consecutive beats in step S1103, while incrementing the value of i by 1 at step S1106, the CPU 201 repeatedly performs step S1104 and step S1105 (for any of #0-#3) for the 16 beats until the value of i is determined to have exceeded 15 at step S1107.

In this repeat processing, the CPU 201 first loads a slider value (s) of the slider at beat position i in the bend sliders 105 described in FIG. 4 via the key scanner 206 from the bend sliders 105 in FIG. 2, and then makes a determination based on this value (step S1104).

Next, if the slider value s at beat position i is equal to 0, the CPU 201 stores the number 0, for bend curve 401 (#0) in FIG. 4 and FIG. 7, under the bend curve number heading in the bend curve settings table 600 in FIG. 6. Values for the measure number and beat number headings at this time are calculated using Equation (3) and Equation (4) below and stored therein (the preceding is step S1105 (#0)).

$$\text{Measure number}=(\text{measure number specified at } S1101)+(\text{the integer part of } 4/i) \quad (3)$$

$$\text{Beat number}=\text{the remainder of beat position } i/4 \quad (4)$$

Next, if the slider value s at beat position i is equal to 1, the CPU 201 stores the number 1, for bend curve 401 (#1) in FIG. 4 and FIG. 7, under the bend curve number heading in the bend curve settings table 600 in FIG. 6. Values for the measure number and beat number headings at this time are calculated using Equation (3) and Equation (4) and stored therein (the preceding is step S1105 (#1)).

Next, if the slider value s at beat position i is equal to 2, the CPU 201 stores the number 2, for bend curve 401 (#2) in FIG. 4 and FIG. 7, under the bend curve number heading in the bend curve settings table 600 in FIG. 6. Values for the measure number and beat number headings at this time are calculated using Equation (3) and Equation (4) and stored therein (the preceding is step S1105 (#2)).

Next, if the slider value s at beat position i is equal to 3, the CPU 201 stores the number 3, for bend curve 401 (#3) in FIG. 4 and FIG. 7, under the bend curve number heading in the bend curve settings table 600 in FIG. 6. Values for the measure number and beat number headings at this time are calculated using Equation (3) and Equation (4) and stored therein (the preceding is step S1105 (#3)).

When the value of the variable i is determined to have reached 15 at step S1107 in this repeat processing, the CPU 201 ends the processing of the flowchart in FIG. 11, and ends the bend-curve-setting processing at step S1008 in FIG. 10.

Figure 12:
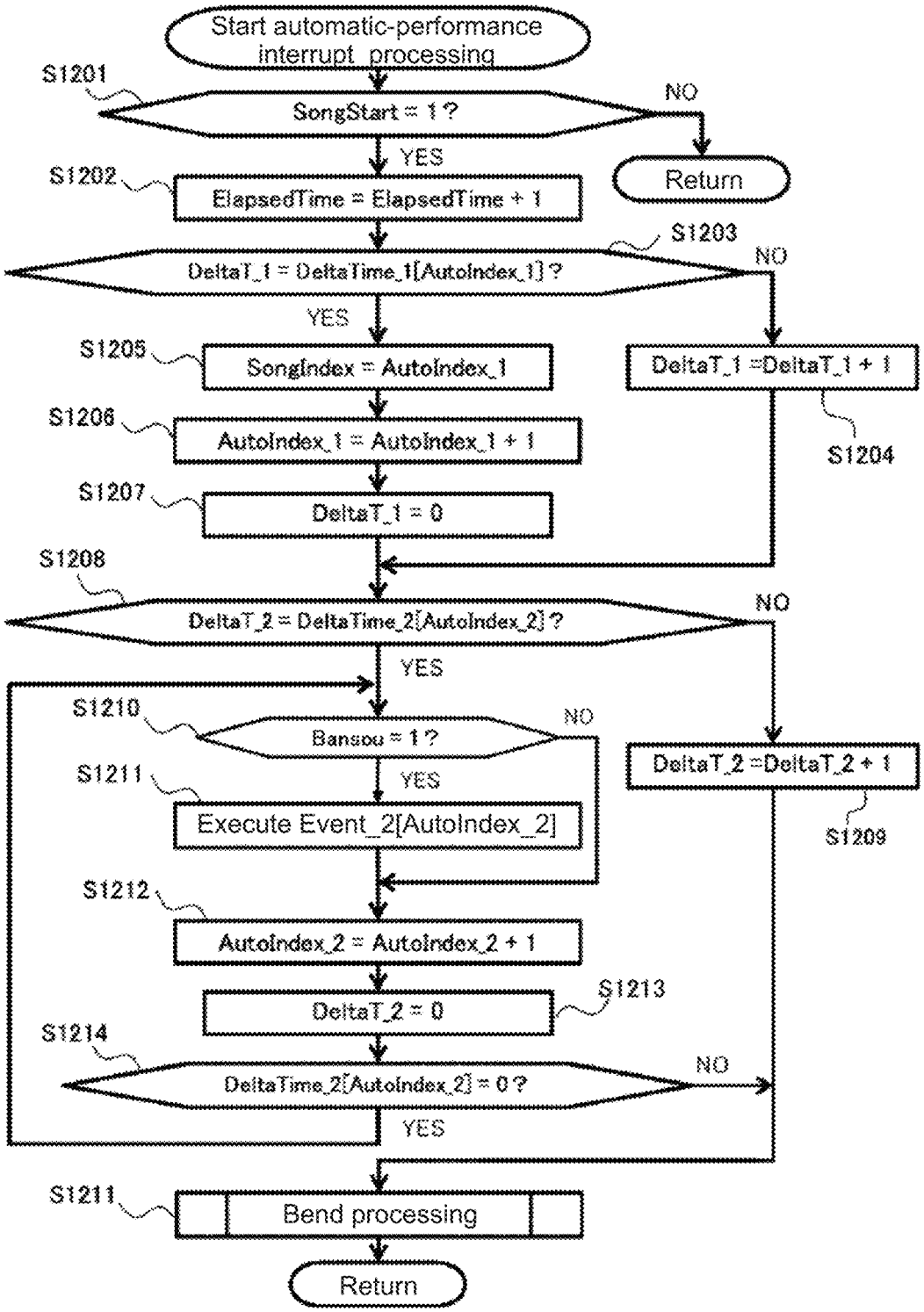
FIG. 12 is a flowchart illustrating a detailed example of automatic-performance interrupt processing.

FIG. 12 is a flowchart illustrating a detailed example of the automatic-performance interrupt processing performed based on the interrupts generated by the timer 210 in FIG. 2 every TickTime (sec) (see step S902 in FIG. 9A, or step S912 in FIG. 9B). The following processing is performed on the performance data pairs in the first and second track chunks in the musical piece data illustrated in FIG. 5.

First, the CPU 201 performs a series of processes corresponding to the first track chunk (steps S1201 to S1207). The CPU 201 starts by determining whether or not the value of SongStart is equal to 1, in other words, whether or not advancement of the lyrics and accompaniment has been instructed (step S1201).

When the CPU 201 has determined there to be no instruction to advance the lyrics and accompaniment (the determination of step S1201 is NO), the CPU 201 ends the automatic-performance interrupt processing illustrated in the flowchart of FIG. 12 without advancing the lyrics and accompaniment.

When the CPU 201 has determined there to be an instruction to advance the lyrics and accompaniment (the determination of step S1201 is YES), the value of the ElapseTime variable in the RAM 203, which indicates the amount of time that has elapsed since the start of the automatic performance in units of TickTime, is incremented by 1. Because the automatic-performance interrupt processing of FIG. 12 occurs each TickTime, the value of ElapseTime is a value that increases by 1 each time this interrupt occurs. The value of the ElapseTime variable is used to calculate the current measure number and beat number in step S1406 of the bend processing of FIG. 14, described later.

Next, the CPU 201 then determines whether or not the value of DeltaT_1, which indicates the relative time since the last event in the first track chunk, matches the wait time DeltaTime_1[AutoIndex_1] of the performance data pair indicated by the value of AutoIndex_1 that is about to be executed (step S1203).

If the determination of step S1203 is NO, the CPU 201 increments the value of DeltaT_1, which indicates the relative time since the last event in the first track chunk, by 1, and the CPU 201 allows the time to advance by 1 TickTime corresponding to the current interrupt (step S1204). Following this, the CPU 201 proceeds to step S1208, which will be described later.

If the determination of step S1203 is YES, the CPU 201 executes the first track chunk event Event_1[AutoIndex_1] of the performance data pair indicated by the value of AutoIndex_1 (step S1205). This event is a rap event that includes lyric data.

Then, the CPU 201 stores the value of AutoIndex_1, which indicates the position of the rap event that should be performed next in the first track chunk, in the SongIndex variable in the RAM 203 (step S1205).

The CPU 201 then increments the value of AutoIndex_1 for referencing the performance data pairs in the first track chunk by 1 (step S1206).

Next, the CPU 201 resets the value of DeltaT_1, which indicates the relative time since the rap event most recently referenced in the first track chunk, to 0 (step S1207). Following this, the CPU 201 proceeds to the processing at step S1208.

Next, the CPU 201 performs a series of processes corresponding to the second track chunk (steps S1208 to S1214). The CPU 201 starts by determining whether or not the value of DeltaT_2, which indicates the relative time since the last event in the second track chunk, matches the wait time DeltaTime_2[AutoIndex_2] of the performance data pair indicated by the value of AutoIndex_2 that is about to be executed (step S1208).

If the determination of step S1208 is NO, the CPU 201 increments the value of DeltaT_2, which indicates the relative time since the last event in the second track chunk, by 1, and the CPU 201 allows the time to advance by 1 TickTime corresponding to the current interrupt (step S1209). Following this, the CPU 201 proceeds to the bend processing at step S1211.

If the determination of step S1208 is YES, the CPU 201 then determines whether or not the value of the Bansou variable in the RAM 203 that denotes accompaniment playback is equal to 1 (has accompaniment) (step S1210) (see steps S924 to S926 in FIG. 9C).

If the determination of step S1210 is YES, the CPU 201 executes the second track chunk accompaniment event Event_2[AutoIndex_2] indicated by the value of AutoIndex_2 (step S1211). If the event Event_2[AutoIndex_2] executed here is, for example, a "note on" event, the key number and velocity specified by this "note on" event are used to issue a command to the sound source LSI 204 in FIG. 2 to generate sound for a musical tone in the accompaniment. However, if the event Event_2[AutoIndex_2] is, for example, a "note off" event, the key number and velocity specified by this "note off" event are used to issue a command to the sound source LSI 204 in FIG. 2 to silence a musical tone being generated for the accompaniment.

However, if the determination of step S1210 is NO, the CPU 201 skips step S1211 and proceeds to the processing at the next step S1212 without executing the current accompaniment event Event_2[AutoIndex_2]. Here, in order to progress in sync with the lyrics, the CPU 201 performs only control processing that advances events.

After step S1211, or when the determination of step S1210 is NO, the CPU 201 increments the value of AutoIndex_2 for referencing the performance data pairs for accompaniment data in the second track chunk by 1 (step S1212).

Next, the CPU 201 resets the value of DeltaT_2, which indicates the relative time since the event most recently executed in the second track chunk, to 0 (step S1213).

Then, the CPU 201 determines whether or not the wait time DeltaTime_2[AutoIndex_2] of the performance data pair indicated by the value of AutoIndex_2 to be executed next in the second track chunk is equal to 0, or in other words, whether or not this event is to be executed at the same time as the current event (step S1214).

If the determination of step S1214 is NO, the CPU 201 proceeds to the bend processing of step S1211.

If the determination of step S1214 is YES, the CPU 201 returns to step S1210, and repeats the control processing relating to the event Event_2[AutoIndex_2] of the performance data pair indicated by the value of AutoIndex_2 to be executed next in the second track chunk. The CPU 201 repeatedly performs the processing of steps S1210 to S1214 the same number of times as there are events to be simultaneously executed. The above processing sequence is performed when a plurality of "note on" events are to generate sound at simultaneous timings, as for example happens in chords and the like.

After the processing at step S1209, or if the determination of step S1214 is NO, the CPU 201 performs bend processing (step S1211). Here, on the basis of the bend curve settings of each measure, and each beat in the measures, that have been set in the bend curve settings table 600 illustrated in FIG. 6 through the bend-curve-setting processing at step S1008 in FIG. 10, processing is performed that corresponds to the bend processor 320 in FIG. 3 with which bending is implemented with respect to the voice synthesis section 302 in FIG. 3 in practice. The details of this processing will be described later using the flowchart in FIG. 14. After the processing at step S1209, the CPU 201 ends the automatic-performance interrupt processing illustrated in the flowchart of FIG. 12.

Figure 13:
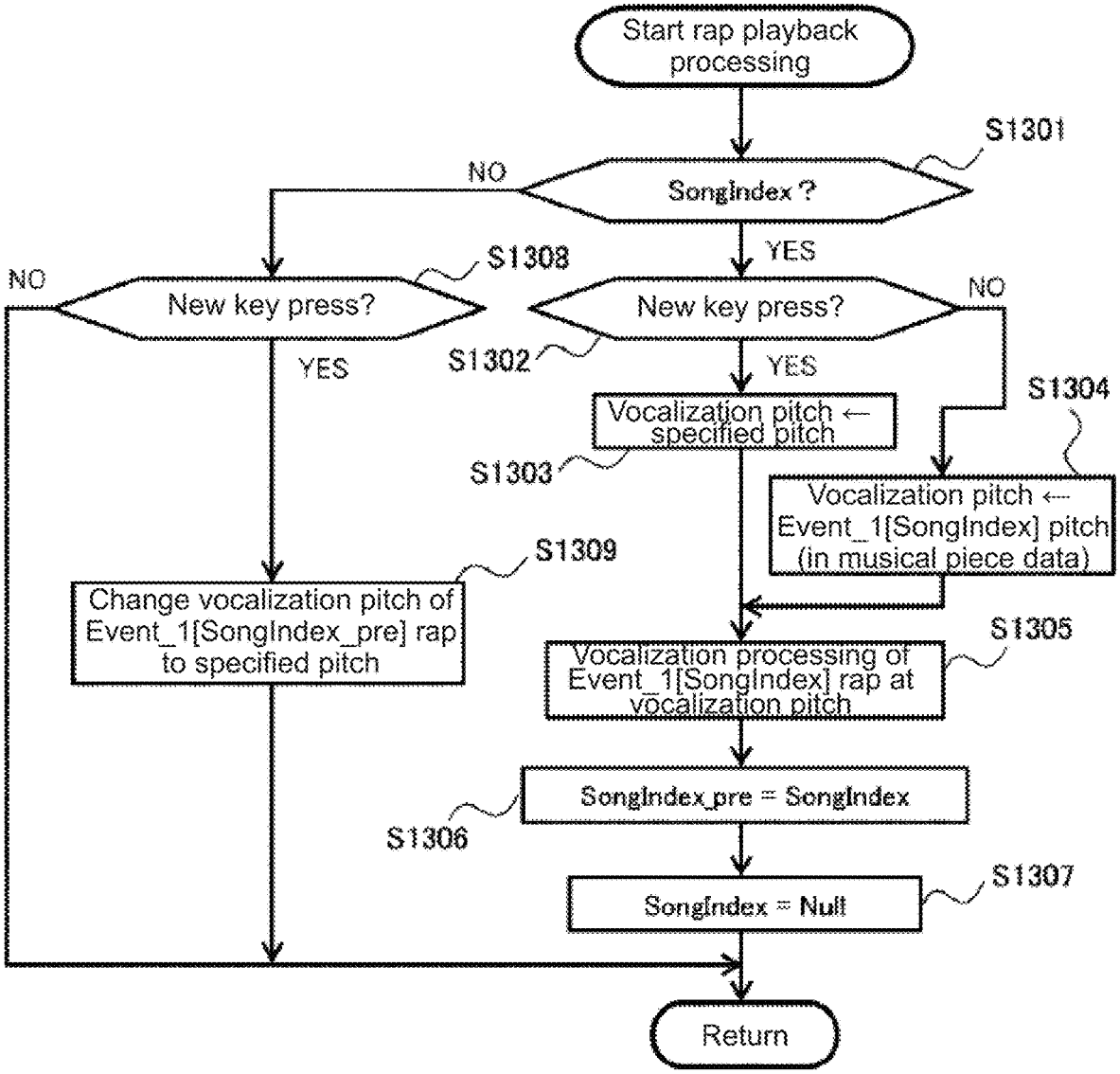
FIG. 13 is a flowchart illustrating a detailed example of rap playback processing.

FIG. 13 is a flowchart illustrating a detailed example of the rap playback processing at step S805 in FIG. 8.

First, at step S1205 in the automatic-performance interrupt processing of FIG. 12, the CPU 201 determines whether or not a value has been set for the SongIndex variable in the RAM 203, and that this value is not a null value (step S1301). The SongIndex value indicates whether or not the current timing is a rap voice playback timing.

If the determination of step S1301 is YES, that is, if the present time is a rap playback timing, the CPU 201 then determines whether or not a new performer key press on the keyboard 101 in FIG. 1 has been detected by the keyboard processing at step S803 in FIG. 8 (step S1302).

If the determination of step S1302 is YES, the CPU 201 sets the pitch specified by a performer key press to a non-illustrated register, or to a variable in the RAM 203, as a vocalization pitch (step S1303).

Then, the CPU 201 reads the rap lyric string from the rap event Event_1[SongIndex] in the first track chunk of the musical piece data in the RAM 203 indicated by the SongIndex variable in the RAM 203. The CPU 201 generates rap data 215 for vocalizing, at the vocalization pitch set to the pitch based on a key press that was set at step S1303, rap voice output data 217 corresponding to the lyric string that was read, and instructs the voice synthesis LSI 205 to perform vocalization processing (step S1305). The voice synthesis LSI 205 performs the statistical voice synthesis processing described with reference to FIG. 3, whereby lyrics from the RAM 203 specified as musical piece data are, in real time, synthesized into and output as rap voice output data 217 to be sung at the pitch of keys on the keyboard 101 pressed by a performer.

If at step S1301 it is determined that the present time is a rap playback timing and the determination of step S1302 is NO, that is, if it is determined that no new key press is detected at the present time, the CPU 201 reads the data for a pitch from the rap event Event_1[SongIndex] in the first track chunk of the musical piece data in the RAM 203 indicated by the SongIndex variable in the RAM 203, and sets this pitch to a non-illustrated register, or to a variable in the RAM 203, as a vocalization pitch (step S1304).

In the case of a rap performance, pitch may, or may not be, linked with the pitch of a melody.

Then, by performing the processing at step S1305, described above, the CPU 201 generates rap data 215 for vocalizing, at the vocalization pitch set at step S1304, rap voice output data 217 corresponding to the lyric string that was read from the rap event Event_1[SongIndex], and instructs the voice synthesis LSI 205 to perform vocalization processing (step S1305). In performing the statistical voice synthesis processing described with reference to FIG. 3, even if a performer has not pressed a key on the keyboard 101, the voice synthesis LSI 205, as rap voice output data 217 to be sung in accordance with a default pitch specified in the musical piece data, synthesizes and outputs lyrics from the RAM 203 specified as musical piece data in a similar manner.

After the processing of step S1305, the CPU 201 stores the rap position at which playback was performed indicated by the SongIndex variable in the RAM 203 in a SongIndex_pre variable in the RAM 203 (step S1306).

Then, the CPU 201 clears the value of the SongIndex variable so as to become a null value and makes subsequent timings non-rap playback timings (step S1307). The CPU 201 subsequently ends the rap playback processing at step S805 in FIG. 8 illustrated in the flowchart of FIG. 13.

If the determination of step S1301 is NO, that is, if the present time is not a rap playback timing, the CPU 201 then determines whether or not a new performer key press on the keyboard 101 in FIG. 1 has been detected by the keyboard processing at step S803 in FIG. 8 (step S1308).

If the determination of step S1308 is NO, the CPU 201 ends the rap playback processing at step S805 in FIG. 8 illustrated in the flowchart of FIG. 13.

If the determination of step S1308 is YES, the CPU 201 generates rap data 215 instructing that the pitch of the rap voice output data 217 currently undergoing vocalization processing in the voice synthesis LSI 205, which corresponds to the lyric string for rap event Event_1[SongIndex_pre] in the first track chunk of the musical piece data in the RAM 203 indicated by the SongIndex_pre variable in the RAM 203, is to be changed to the pitch based on the performer key press detected at step S1308, and outputs the rap data 215 to the voice synthesis LSI 205 (step S1309). At such time, the frame in the rap data 215 where a latter phoneme among phonemes in the lyrics already being subjected to vocalization processing starts is set as the starting point of the change to the specified pitch. For example, in the case of the lyric string "Ki", the this is the frame where the latter phoneme /i/ in the constituent phoneme sequence /k/ /i/ starts. The voice synthesis LSI 205 performs the statistical voice synthesis processing described with reference to FIG. 3, whereby the pitch of the rap voice currently being vocalized is changed, in real time, to the pitch of the pitch of a key on the keyboard 101 pressed by a performer and synthesized into and output as rap voice output data 217 to be sung.

Due to the processing at step S1309, the pitch of vocalization of rap voice output data 217 vocalized from an original timing immediately before the current key press timing is able to be changed to the pitch played by the performer and continue being vocalized at the current key press timing.

After the processing at step S1309, the CPU 201 ends the rap playback processing at step S805 in FIG. 8 illustrated in the flowchart of FIG. 13.

Figure 14:
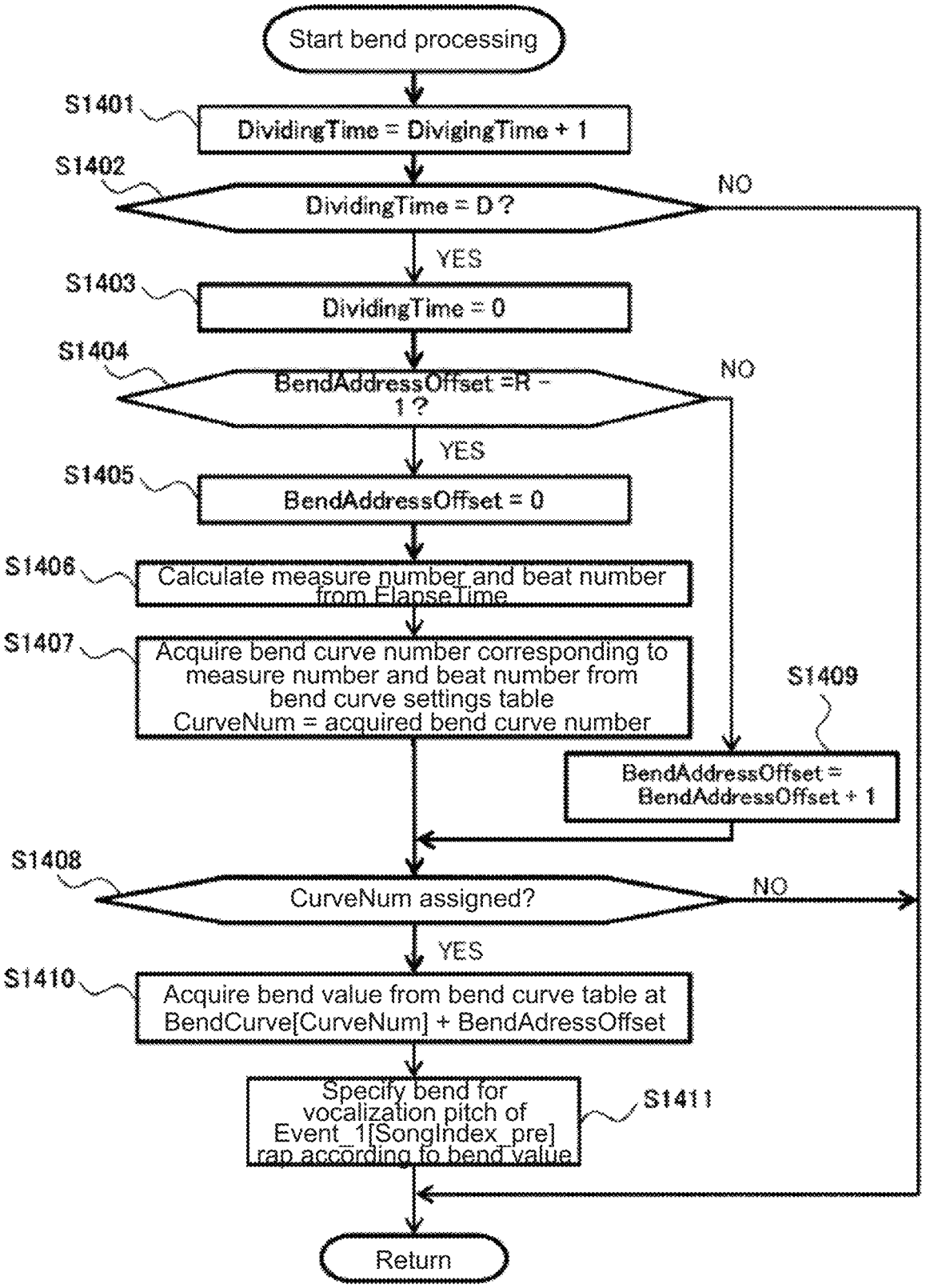
FIG. 14 is a flowchart illustrating a detailed example of bend processing.

FIG. 14 is a flowchart illustrating a detailed example of the bend processing at step S1211 of the automatic-performance interrupt processing in FIG. 12. Here, the CPU 201 first increments the value of the DividingTime variable in the RAM 203 by 1 (step S1401).

Then, the CPU 201 determines whether or not the value of the DividingTime variable matches the value of D calculated using Equation (2) (step S1402). If the determination of step S1402 is NO, the CPU 201 ends the bend processing at step S1211 in FIG. 12 illustrated in the flowchart of FIG. 14. D is a value that indicates a frequency in terms of TickTime. Accordingly, while the automatic-performance interrupt processing of FIG. 12 is performed every 1 TickTime, among these, the substantive processing of the bend processing in FIG. 14 being invoked is only performed every D TickTimes. For example, if D=10, the bend processing would be performed every 10 TickTimes. "Because the value of the DividingTime variable is initialized to D−1 in step S921 of the rap-starting processing of FIG. 9C, when the automatic-performance interrupt processing is first performed at the start of an automatic performance, after the processing of step S1401, the determination of step S1402 is necessarily YES.

If the determination of step S1402 is YES, the CPU 201 resets the value of the DividingTime variable to 0 (step S1403).

Next, the CPU 201 determines whether or not the value of the BendAdressOffset variable in the RAM 203 matches the last address R−1 in one bend curve (step S1404). Here, the CPU 201 determines whether or not bend processing with respect to a single beat has ended. Because the value of the BendAdressOffset variable is initialized to R−1 in step S921 of the rap-starting processing of FIG. 9C, when the automatic-performance interrupt processing is first performed at the start of an automatic performance, the determination of step S1404 is necessarily YES.

If the determination of step S1404 is YES, the CPU 201 resets the value of the BendAdressOffset variable to 0, which indicates the beginning of a bend curve (see FIG. 7) (step S1405).

Then, the CPU 201 calculates the current measure number and beat number from the value of the ElapseTime variable (step S1406). In the case of a 4/4 time signature, because the number of TickTimes per beat is given in terms of the value of TimeDivision, the ElapseTime variable is divided by the value of TimeDivision, and the result thereof is further divided by four (the number of beats per measure), whereby the current measure number and beat number can be calculated.

Next, the CPU 201 acquires the bend curve number corresponding to the measure number and beat number calculated at step S1406 from the bend curve settings table 600 illustrated in FIG. 6, and this value is set to a CurveNum variable in the RAM 203 (step S1407).

However, if the value of the BendAdressOffset variable in the RAM 203 has not reached the last address R−1 in one bend curve and the determination of step S1404 is NO, the CPU 201 increments the value of the BendAdressOffset variable indicating the offset address in the bend curve by 1 (step S1409).

Next, the CPU 201 determines whether or not a bend curve number was assigned to CurveNum variable data by the processing of step S1407 in the current or previous automatic-performance interrupt processing (step S1408).

If the determination of step S1408 is YES, the CPU 201 adds the offset value assigned to the BendAdressOffset variable to the beginning address BendCurve[CurveNum] in the bend curve data in the ROM 202 corresponding to the bend curve number assigned to the CurveNum variable, and acquires a bend value from the resulting address in the bend curve table 700 (see FIG. 7) (step S1410).

Finally, similarly to described for step S1309 in FIG. 13, the CPU 201 generates rap data 215 instructing that the pitch of the rap voice output data 217 currently undergoing vocalization processing in the voice synthesis LSI 205, which corresponds to the lyric string for rap event Event_1 [SongIndex_pre] in the first track chunk of the musical piece data in the RAM 203 indicated by the SongIndex_pre variable in the RAM 203, is to be changed to the pitch calculated from the bend value acquired at step S1410, and outputs the rap data 215 to the voice synthesis LSI 205. The CPU 201 subsequently ends the bend processing at step S1211 in FIG. 12 illustrated in the flowchart of FIG. 14.

If no bend curve number is assigned to the CurveNum variable and the determination of step S1408 is NO, because the bend curve setting has been disabled by the user for that beat, the CPU 201 ends the bend processing at step S1211 in FIG. 12 illustrated in the flowchart of FIG. 14.

In this manner, in the present embodiment, bend processing corresponding to a bend curve that is specified in real time or has been specified in advance by a user for each beat is able to be performed with respect to rap sounds.

In addition to the embodiments described above, when the bend processor 320 in FIG. 3 has specified a bend curve that varies in a section where beats connect, so that there is no discontinuity between an initial pitch of the current beat and an ending pitch of a previous beat changed by the bend curve, processing may be performed that either carries over the ending pitch of the previous beat or that performs interpolation for the time between these pitches. This makes it possible to generate high-quality rap sounds in which abnormal sounds, etc., are suppressed.

In the embodiments described above, a user sets a bend curve per beat within, for example, 16 consecutive beats (four measures in the case of a 4/4 time signature). However, a user interface may be employed that specifies, en bloc, 16 beat bend curve sets. This makes it easy to make specifications that imitate rap performances by well-known rap singers.

A emphasis unit may also be provided that changes bend curves and emphasizes intonations either randomly or every given number of consecutive beats (e.g., four beats), such as at the beginning of a measure. This makes a greater variety of rap expressions possible.

In the embodiments above, bend processing is performed as a pitch bend of the pitch of a rap voice. However, bend processing may be performed with respect to aspects other than pitch, such as, for example, the intensity or tone color of sounds. This makes a greater variety of rap expressions possible.

In the embodiments above, the specification of intonation patterns is performed with respect to a rap voice. However, the specification of intonation patterns may be performed with respect to sounds other than of a rap voice, such as musical information for musical instrument sounds.

In the first embodiment of statistical voice synthesis processing employing HMM acoustic models described with reference to FIGS. 3 and 4, it is possible to reproduce subtle musical expressions, such as for particular singers or singing styles, and it is possible to achieve a voice quality that is smooth and free of connective distortion. The training result 315 can be adapted to other rap singers, and various types of voices and emotions can be expressed, by performing a transformation on the training results 315 (model parameters). All model parameters for HMM acoustic models are able to be automatically learned from training rap data 311 and training rap voice data 312. This makes it possible to automatically create a voice synthesis system in which the features of a particular singer are acquired as HMM acoustic models and these features are reproduced during synthesis. The fundamental frequency and duration of a voice follows the melody and tempo in a musical score, and changes in pitch over time and the temporal structure of rhythm can be uniquely established from the musical score. However, a rap voice synthesized therefrom is dull and mechanical, and lacks appeal as a rap voice. Actual rap voices are not standardized as in a musical score, but rather have a style that is specific to each singer due to voice quality, pitch of voice, and changes in the structures thereof over time. In the first embodiment of statistical voice synthesis processing in which HMM acoustic models are employed, time series variations in spectral information and pitch information in a rap voice is able to be modeled on the basis of context, and by additionally taking musical score information into account, it is possible to reproduce a voice that is even closer to an actual rap voice. The HMM acoustic models employed in the first embodiment of statistical voice synthesis processing correspond to generative models that consider how, with regards to vibration of the vocal cords and vocal tract characteristics of a singer, an acoustic feature sequence of a voice changes over time during vocalization when lyrics are vocalized in accordance with a given melody. In the first embodiment of statistical voice synthesis processing, HMM acoustic models that include context for "lag" in voice sounds and musical notes are used. The synthesis of rap voice sounds that are able to accurately reproduce singing techniques having a tendency to change in a complex manner depending on the singing voice characteristics of the singer is implemented thereby. By fusing such techniques in the first embodiment of statistical voice synthesis processing, in which HMM acoustic models are employed, with real-time performance technology using the electronic keyboard instrument 100, for example, singing techniques and vocal qualities of a model singer that were not possible with a conventional electronic musical instrument employing concatenative synthesis or the like are able to be reflected accurately, and performances in which a rap voice sounds as if that rap singer were actually rapping are able to be realized in concert with, for example, a keyboard performance on the electronic keyboard instrument 100.

In the second embodiment of statistical voice synthesis processing employing a DNN acoustic model described with reference to FIGS. 3 and 5, the decision tree based context-dependent HMM acoustic models in the first embodiment of statistical voice synthesis processing, in which relationships between linguistic feature sequences and acoustic feature sequences are expressed, are replaced with a DNN. It is thereby possible to express relationships between linguistic feature sequences and acoustic feature sequences using complex non-linear transformation functions that are difficult to express in a decision tree. In decision tree based context-dependent HMM acoustic models, because corresponding training data is also classified based on decision trees, the training data allocated to each context-dependent HMM acoustic model is reduced. In contrast, training data is able to be efficiently utilized in a DNN acoustic model because all of the training data is used to train a single DNN. Thus, with a DNN acoustic model it is possible to predict acoustic features with greater accuracy than with HMM acoustic models, and the naturalness of voice synthesis is able be greatly improved. In a DNN acoustic model, it is possible to use linguistic feature sequences relating to frames. In other words, in a DNN acoustic model, because temporal correspondence between acoustic feature sequences and linguistic feature sequences is determined in advance, it is possible to utilize linguistic features relating to frames, such as "the number of consecutive frames for the current phoneme" and "the position of the current frame inside the phoneme". Such linguistic features are not easy taken into account in HMM acoustic models. Thus using linguistic feature relating to frames allows features to be modeled in more detail and makes it possible to improve the naturalness of voice synthesis. By fusing such techniques in the second embodiment of statistical voice synthesis processing, in which a DNN acoustic model is employed, with real-time performance technology using the electronic keyboard instrument 100, for example, rap voice performances based on a keyboard performance, for example, can be made to more naturally approximate the singing techniques and vocal qualities of a model rap singer.

In the embodiments described above, statistical voice synthesis processing techniques, employed as voice synthesis methods, can be implemented with markedly less memory capacity compared to conventional concatenative synthesis. For example, in an electronic musical instrument that uses concatenative synthesis, memory having several hundred megabytes of storage capacity is needed for voice sound fragment data. However, the present embodiments get by with memory having just a few megabytes of storage capacity in order to store training result 315 model parameters in FIG. 3. This makes it possible to provide a lower cost electronic musical instrument, and allows rap performance systems with high quality sound to be used by a wider range of users.

Moreover, with conventional fragmentary data methods, it takes a great deal of time (years) and effort to produce data for rap performances since fragmentary data needs to be adjusted by hand. However, because almost no data adjustment is necessary to produce training result 315 model parameters for the HMM acoustic models or the DNN acoustic model of the present embodiments, performance data can be produced with only a fraction of the time and effort. This also makes it possible to provide a lower cost electronic musical instrument. Further, using a server computer 300 available for use as a cloud service, or training functionality built into the voice synthesis LSI 205, general users can train the electronic musical instrument using their own voice, the voice of a family member, the voice of a famous person, or another voice, and have the electronic musical instrument give a rap performance using this voice for a model voice. In this case too, rap performances that are markedly more natural and have higher quality sound than hitherto are able to be realized with a lower cost electronic musical instrument.

In the embodiments described above, the present invention is embodied as an electronic keyboard instrument. However, the present invention can also be applied to electronic string instruments and other electronic musical instruments.

Voice synthesis methods able to be employed for the vocalization model unit 308 in FIG. 3 are not limited to cepstrum voice synthesis, and various voice synthesis methods, such as LSP voice synthesis, may be employed therefor.

In the embodiments described above, a first embodiment of statistical voice synthesis processing in which HMM acoustic models are employed and a subsequent second embodiment of a voice synthesis method in which a DNN acoustic model is employed were described. However, the present invention is not limited thereto. Any voice synthesis method using statistical voice synthesis processing may be employed by the present invention, such as, for example, an acoustic model that combines HMMs and a DNN.

In the embodiments described above, rap lyric information is given as musical piece data. However, text data obtained by voice recognition performed on content being sung in real time by a performer may be given as rap lyric information in real time.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A keyboard instrument comprising:

a keyboard that includes a row of a plurality of keys;

a plurality of operation elements provided behind the row of the plurality of keys on an instrument casing, the plurality of operation elements including a first operation element associated with a first segment data for a first time segment of a voice data that is to be output, and a second operation element associated with a second segment data for a second time segment that immediately follows the first time segment of the voice data; and at least one processor, wherein the at least one processor:

determines a first pattern of intonation to be applied to the first time segment of the voice data on the basis of a first user operation on the first operation element, causes a first voice for the first time segment to be digitally synthesized from the first segment data in accordance with the determined first pattern of intonation and causes the digitally synthesized first voice to output, determines a second pattern of intonation to be applied to the second time segment of the voice data on the basis of a second user operation on the second operation element, and causes a second voice for the second time segment to be digitally synthesized from the second segment data in accordance with the determined second pattern of intonation and causes the digitally synthesized second voice to output, and wherein the at least one processor, when the number of data segments in the voice data is greater than the number of the plurality of operation elements, causes the first operation element to be reassigned to segment data of the voice data for a time segment that comes after the second time segment after the digitally synthesized first voice is output.

2. The keyboard instrument according to claim 1, wherein the number of the plurality of operation elements is eight, and the voice data contains at least nine segment data respectively for nine successive time segments from the first time segment to a ninth time segment, and wherein the at least one processor associates, at a given timing, the first segment data through eighth segment data of the voice data with the plurality of operation elements, respectively, and the at least one processor causes the first operation element to be reassigned to the segment data of the voice data for the ninth time segment that follows the segment data for the eighth time segment after the digitally synthesized first voice is output.

3. The keyboard instrument according to claim 1, wherein the at least one processor causes the first voice and the second voice to be synthesized such that an ending pitch of the first voice in the first time segment and an initial pitch of the second voice in the second time segment are linked in a continuous manner.

4. The keyboard instrument according to claim 1, wherein the plurality of operation elements are sliding operation elements, and wherein, for each of the sliding operation elements, the at least one processor determines an intonation pattern from among a plurality of preset intonation patterns in accordance with an amount of slider operation on the sliding operation element.

5. The keyboard instrument according to claim 1, wherein the at least one processor causes a voice to be produced at a pitch specified by an operation on the keyboard.

6. The keyboard instrument according to claim 1, further comprising a memory that stores a trained acoustic model obtained by performing machine learning on training musical score data including training lyric data and training pitch data, and on training voice data of a singer corresponding to the training musical score data, the trained acoustic model being configured to receive lyric data and pitch data and output acoustic feature data, and wherein the at least one processor:

causes the trained acoustic model to output the acoustic feature data in response to the received lyric data and the received pitch data, and digitally synthesizes an inferred voice that infers a voice of the singer on the basis of the acoustic feature data output by the trained acoustic model, and causes the determined first pattern of intonation to be applied to the inferred voice in the first time segment and outputs the inferred voice that has been applied with the first pattern of intonation.

7. A method performed by at least one processor in a keyboard instrument that includes, in addition to the at least one processor, a keyboard that includes a row of a plurality of keys; and a plurality of operation elements provided behind the row of the plurality of keys on an instrument casing, the plurality of operation elements including a first operation element associated with a first segment data for a first time segment of a voice data that is to be output, and a second operation element associated with a second segment data for a second time segment that immediately follows the first time segment of the voice data, the method comprising, via the at least one processor, determining a first pattern of intonation to be applied to the first time segment of the voice data on the basis of a first user operation on the first operation element, causing a first voice for the first time segment to be digitally synthesized from the first segment data in accordance with the determined first pattern of intonation and causes the digitally synthesized first voice to output, determining a second pattern of intonation to be applied to the second time segment of the voice data on the basis of a second user operation on the second operation element, and causing a second voice for the second time segment to be digitally synthesized from the second segment data in accordance with the determined second pattern of intonation and causes the digitally synthesized second voice to output, wherein when the number of data segments in the voice data is greater than the number of the plurality of operation elements, the first operation element is reassigned to segment data of the voice data for a time segment that comes after the second time segment after the digitally synthesized first voice is output.

8. The method according to claim 7, wherein the number of the plurality of operation elements is eight, and the voice data contains at least nine segment data respectively for nine successive time segments from the first time segment to a ninth time segment, and wherein at a given timing, the first segment data through eighth segment data of the voice data are associated with the plurality of operation elements, respectively, and the first operation element is reassigned to the segment data of the voice data for the ninth time segment that follows the segment data for the eighth time segment after the digitally synthesized first voice is output.

9. The method according to claim 7, wherein the first voice and the second voice are synthesized such that an ending pitch of the first voice in the first time segment and an initial pitch of the second voice in the second time segment are linked in a continuous manner.

10. The method according to claim 7, wherein the plurality of operation elements are sliding operation elements, and wherein, for each of the sliding operation elements, an intonation pattern is determined from among a plurality of preset intonation patterns in accordance with an amount of slider operation on the sliding operation element.

11. The method according to claim 7, wherein a voice is produced at a pitch specified by an operation on the keyboard.

12. The method according to claim 7, wherein the keyboard instrument further includes a memory that stores a trained acoustic model obtained by performing machine learning on training musical score data including training lyric data and training pitch data, and on training voice data of a singer corresponding to the training musical score data, the trained acoustic model being configured to receive lyric data and pitch data and output acoustic feature data, and wherein the method includes, via the at least one processor:

causing the trained acoustic model to output the acoustic feature data in response to the received lyric data and the received pitch data, and digitally synthesizing an inferred voice that infers a voice of the singer on the basis of the acoustic feature data output by the trained acoustic model, and causing the determined first pattern of intonation to be applied to the inferred voice in the first time segment and outputs the inferred voice that has been applied with the first pattern of intonation.

* * * * *